US010026516B2

(12) United States Patent
Yoshimizu et al.

(10) Patent No.: US 10,026,516 B2
(45) Date of Patent: Jul. 17, 2018

(54) COLLIMATOR APPARATUS, RADIATION SYSTEM, AND METHOD FOR CONTROLLING COLLIMATORS

(71) Applicants: Eiki Yoshimizu, Kanagawa (JP); Hiroshi Koide, Kanagawa (JP); Masashi Yamamoto, Kanagawa (JP); Masaaki Ito, Kanagawa (JP)

(72) Inventors: Eiki Yoshimizu, Kanagawa (JP); Hiroshi Koide, Kanagawa (JP); Masashi Yamamoto, Kanagawa (JP); Masaaki Ito, Kanagawa (JP)

(73) Assignee: Accuthera Inc., Kanagawa (JP)

( * ) Notice: Subject to any disclaimer, the term of this patent is extended or adjusted under 35 U.S.C. 154(b) by 209 days.

(21) Appl. No.: 15/220,554

(22) Filed: Jul. 27, 2016

(65) Prior Publication Data

US 2017/0032864 A1 Feb. 2, 2017

(30) Foreign Application Priority Data

Jul. 29, 2015 (JP) ..... 2015-149760
Jun. 3, 2016 (JP) ..... 2016-111954

(51) Int. Cl.
*G21K 1/02* (2006.01)

(52) U.S. Cl.
CPC ..... *G21K 1/02* (2013.01)

(58) Field of Classification Search
CPC ..... G21K 1/02
See application file for complete search history.

(56) References Cited

U.S. PATENT DOCUMENTS

| | | | |
|---|---|---|---|
| 5,278,886 | A | 1/1994 | Kobiki et al. |
| 7,085,347 | B2 | 8/2006 | Mihara et al. |
| 7,553,599 | B2 | 6/2009 | Ohtani |
| 8,086,004 | B2 | 12/2011 | Kuduwalli et al. |
| 2013/0336449 | A1 | 12/2013 | Tanabe |

FOREIGN PATENT DOCUMENTS

| | | |
|---|---|---|
| JP | S60-017838 Y | 5/1985 |
| JP | H05-188199 | 7/1993 |
| JP | H05-253309 | 10/1993 |
| JP | H05-337207 | 12/1993 |
| JP | 2001-037723 | 2/2001 |
| JP | 2003-175117 | 6/2003 |
| JP | 2004-065808 | 3/2004 |
| JP | 2004-097471 | 4/2004 |
| JP | 2005-121833 | 5/2005 |
| JP | 2006-227174 | 8/2006 |
| JP | 2006-301427 | 11/2006 |
| JP | 2007-267971 | 10/2007 |
| JP | 2008-165064 | 7/2008 |
| JP | 2014-000128 | 1/2014 |
| JP | 5425808 | 2/2014 |

*Primary Examiner* — Mark R Gaworecki
(74) *Attorney, Agent, or Firm* — IPUSA, PLLC

(57) ABSTRACT

There is provided a collimator apparatus including a first collimator configured to prevent a leakage of radiation, wherein a target for converting electron beam emitted from an electron beam source into the radiation is disposed in the first collimator, and a second collimator, wherein the radiation passes through the second collimator along a central axis of the second collimator, the second collimator being disposed in an inner space formed in the first collimator, a gap between a surface of the inner space and the second collimator being provided, wherein the second collimator swings within the inner space of the first collimator.

15 Claims, 26 Drawing Sheets

COLLIMATOR APPARATUS, RADIATION SYSTEM, AND METHOD FOR CONTROLLING COLLIMATORS

BACKGROUND OF THE INVENTION

1. Field of the Invention

The present disclosure relates to collimator apparatuses, radiation systems, and methods for controlling collimators.

2. Description of the Related Art

The present disclosure relates to radiation collimator apparatuses and radiation therapy systems using the collimator apparatuses.

In radiation (e.g., X-ray) therapy, X-ray is need to be emitted to affected part that is to be irradiated in a manner such that abnormal cells such as cancer cells are precisely irradiated while normal cells are irradiated as little as possible. However, various shapes of cancer may be found in human body (the object to be irradiated), and the living human body may slightly moves even when a patient silently rests such as in a lying state. The slight movement of human body is caused by movement (e.g., breathing, heartbeat) of lungs, heart, and the like.

In order to follow such movement of organs, a method for achieving "moving body tracking" is proposed, in which a X-ray generation unit, X-ray collimator, etc., is moved so as to have the irradiation field follow the movement of affected part. In Japanese Unexamined Patent Application Publication No. H5-253309, a radiation therapy apparatus for moving a line shaped detection unit that detects X-ray transmitted through the affected part of patient, and moves a movable collimator for limiting irradiation field, thereby keeping the transmitted X-ray within a width-range of the line-shaped detection unit is disclosed. Also, in Japanese Unexamined Patent Application Publication No. H5-337207, a stereotactic radiosurgery apparatus including first stereotactic radiosurgery collimator leaf and second stereotactic radiosurgery collimator leaf having inclined slit is disclosed, where the first stereotactic radiosurgery collimator leaf and second stereotactic radiosurgery collimators leaf are mounted on a irradiation view field forming collimator, and a position control of collimator hole formed at intersection of the slit holes is performed by moving the first stereotactic radiosurgery collimator and second stereotactic radiosurgery collimator. The above described apparatuses form required irradiation fields by appropriately controlling a pair of left collimator and right collimator.

In Japanese Unexamined Patent Application Publication No. 2004-65808, a radiation therapy apparatus, in which a generation source of electron beam and a deflected electromagnet are coupled by a vacuum rotary joint, including a gantry arm for holding a emission head having target or collimator is disclosed, where means for mechanically swinging and rotating the emission head about an axis which is parallel with a rotary axis of a gantry arm, and the axis passes a virtual ray source position. Further, the apparatus includes a means for moving the variable stops in an emission direction of electron beams in an arc-like shape, where the center of the ark corresponds to a position of the source of electron beam. According to the disclosed apparatus, swing operation of the emission head about the axis parallel to the rotation axis of the gantry arm is performed while the collimator is moved in a direction along the rotation axis of the gantry arm. Therefore, the variable stops are controlled to move in two directions. Consequently, the X-ray radiation can be appropriately performed even if the body of the patient moves.

In Japanese Unexamined Patent Application Publication No. 2007-267971 and Japanese Unexamined Patent Application Publication No. 2003-175117, a radiation apparatus is disclosed, in which a therapeutic X-ray generating source is fixed on a supporting base through a rotating mechanism equipped with two mutually-perpendicular rotation axes (gimbal mechanism). The rotating mechanism is controlled so as to direct the irradiation axis to the isocenter. Independently from the rotating mechanism, the position of the source is adjusted in the directions of two axes through a positioning mechanism with respect to the supporting base. According to the disclosed apparatus, directions of the irradiation axis and the central axis of the collimator fixed at the supporting base are adjusted so as to be directed to the isocenter by the rotating mechanism and the positioning mechanism. Therefore, the radiation of the affected part can be performed by setting the irradiation field in accordance with a shape of the affected part.

However, the apparatuses disclosed in Japanese Unexamined Patent Application Publications No. H5-253309 and No. H5-337207, which control the movement of a pair of right collimator and left collimator in only one direction, are not designed taking account of movement speed of the collimator and precision of formed irradiation field. Also, in the apparatus disclosed in Japanese Unexamined Patent Application Publication No. 2004-65808, the gantry arm having the generation source of electron beam and the emission head having the target or collimator are coupled by the vacuum rotary joint. Therefore, instability of X-ray radiation system due to backlash of mechanical system cannot be avoided. Also, in order to form a desired irradiation field, very high precision of the mechanical system is required because a center position of swing operation of the emission head is separated from a center position of movement of the collimator. Further, it is difficult to achieve a high speed operation since the weight of the emission head including the deflected electromagnet, target, collimator, etc., is large. As described above, although a two-dimensional swing operation can be performed, the "moving body tracking" is unlikely achieved by using technologies of related arts.

Apparatuses, disclosed in Japanese Unexamined Patent Application Publications No. 2007-267971 and No. 2003-175117, have a configuration in which the entire therapy radiation source is designed by using the gimbal mechanism so as to enable a control of directivity angle by rotating the X-ray radiation axis about two axes. Therefore, a scale and a weight of the apparatus become great. Therefore, it is difficult to achieve a high speed operation of the control of directivity angle and a high speed operation of moving body tracking.

RELATED ART DOCUMENT

Patent Document

[Patent Document 1]: Japanese Unexamined Patent Application Publication No. H5-253309

[Patent Document 2]: Japanese Unexamined Patent Application Publication No. H5-337207

[Patent Document 3]: Japanese Unexamined Patent Application Publication No. 2004-65808

[Patent Document 4]: Japanese Unexamined Patent Application Publication No. 2007-267971

[Patent Document 5]: Japanese Unexamined Patent Application Publication No. 2003-175117

SUMMARY OF THE INVENTION

An object of the present disclosure is to provide a configuration of collimator device for enabling radiation therapy with a high precision while performing the moving body tracking through a high speed swing operation and an application technology for the configuration of collimator device.

The following configuration is adopted to achieve the aforementioned object.

In one aspect of the embodiment of the present disclosure, there is provided a collimator apparatus including a first collimator configured to prevent a leakage of radiation, wherein a target for converting electron beam emitted from an electron beam source into the radiation is disposed in the first collimator, and a second collimator, wherein the radiation passes through the second collimator along a central axis of the second collimator, the second collimator being disposed in an inner space formed in the first collimator, a gap between a surface of the inner space and the second collimator being provided, wherein the second collimator swings within the inner space of the first collimator.

Other objects, features, and advantages of the present disclosure will become apparent from the following detailed description when read in conjunction with the accompanying drawings.

DETAILED DESCRIPTION OF THE PREFERRED EMBODIMENTS

Figure 1:
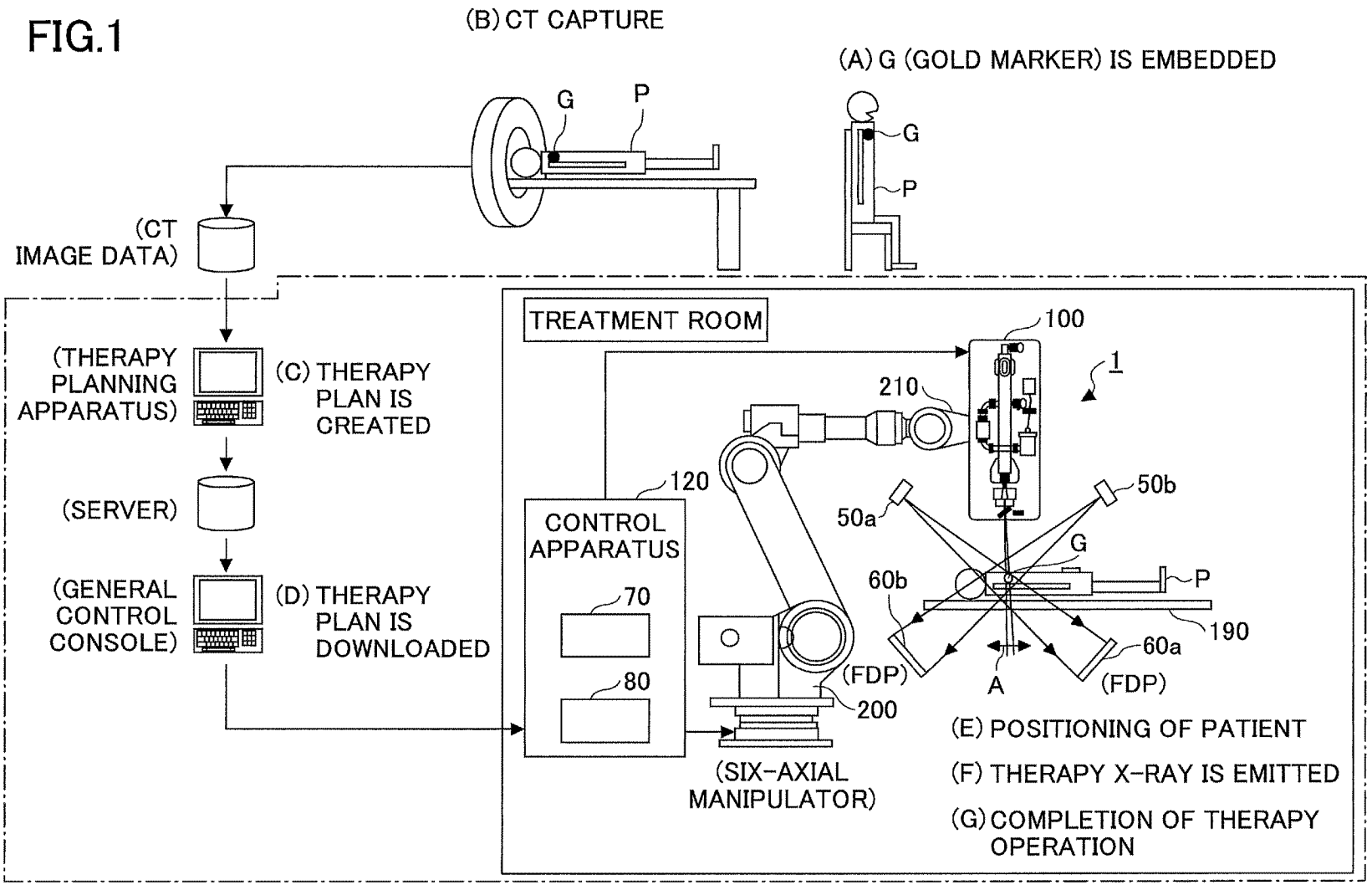
FIG. 1 is a diagram for schematically illustrating a radiation therapy process using a radiation therapy system.

Characteristics of the present disclosure are schematically described before specific embodiments of the present disclosure described.

(1) A collimator apparatus includes, a first collimator (10) configured to prevent a leakage of radiation, wherein a target (4) for converting electron beam generated by an electron beam source into the radiation is disposed in the first collimator, and a second collimator (20), wherein the radiation passes through the second collimator along a central axis of the second collimator, the second collimator being disposed in an inner space formed in the first collimator, a gap (OP) being provided between a surface of the inner space and the second collimator, wherein the second collimator swings within the inner space of the first collimator.

A common electron gun, etc., may be used as the electron source. Also, the electron beam is accelerated by acceleration tube, etc., to collide with "target", thereby generating radiation including X-ray. In this case, a high-frequency electromagnetic wave generated by magnetron, etc., is applied to the acceleration tube so as to accelerate the electron beam.

The second collimator is disposed inside the first collimator, wherein a gap (space) is provided between the second collimator and an inner wall of the first collimator, and the radiation is performed by having the second collimator perform swing operation utilizing the gap so as to scan an object.

The second collimator narrows the radiation to form a desired irradiation field, while the first collimator prevents the generated radiation from leaking outside. Moreover, entire collimator apparatus does not perform the swing operation, but only the second collimator performs the swing operation within the first collimator. Therefore, a high-speed swing operation can be performed. Consequently, a continuous X-ray radiation tracking the affected part moving due to the moving body can be performed.

A third collimator that is inserted in the second collimator and made exchangeable may be used. When the exchangeable third collimator is inserted in the second collimator, the irradiation field can be adjusted or narrowed into a desired shape. When the third collimator is fixed in the second collimator, the third collimator integrally swings with the second collimator.

(2) The collimator apparatus may further include a swing mechanism (25) configured to cause the second collimator to swing in two directions, and a swing mechanism control unit configured to control the swing mechanism.

Consequently, irradiation fields can be formed at a desired position. Preferably, the swing mechanism causes the second collimator to perform the swing operation at least in two orthogonal directions in order to correspond to various patterns of irradiation fields.

(3) Preferably, the target (4) is positioned on the central axis of the second collimator.

A precise radiation onto the affected part can be performed because the target is always on a central axis of the second collimator. For example, a shape of irradiation field, radiation direction, radiation dose, etc., can be adjusted to be desired one.

(4) The collimator apparatus may further include a displacement amount detection unit (30A and 30B) configured to detect a displacement amount of the second collimator with respect to a reference position, wherein the swing mechanism control unit controls the swing mechanism based on the displacement amount detected by the displacement amount detection unit.

Here, the displacement amount is an angle, a distance, and the like.

According to the configuration, the swing mechanism control unit controls the swing mechanism based on the displacement amount detected by displacement amount detection unit. Therefore, a stable swing operation can be performed by feeding back the displacement amount of the second collimator from a reference position. The displacement amount detection unit may be provided as an autocollimator, an encode sensor, and the like.

(5) The collimator apparatus may further include an optical system configured to guiding a visible-light laser beam toward outside the collimator apparatus in a manner such that the optical axis of the visible-light laser beam coincides with the central axis of the second collimator, the visible-light laser beam being emitted from laser source disposed on a member coupled to the second collimator.

According to this configuration, the optical system guides the visible-light laser beam to outside of the apparatus so that the light axis of the visible-light laser beam coincides with the central axis of the second collimator. Therefore, for example, a visual observation of the position on a surface of the affected part on which the radiation is incident can be performed through red visible-light laser beam emitted toward the affected part along the central axis of the second collimator.

(6) The swing mechanism may include voice coil motors (150*a*,150*b*,150*c*,150*d*).

According to this configuration, the swing mechanism including the voice coil motors performs the swing operation of the second collimator. Therefore, high-speed and precise swing operation can be performed.

(7) The collimator apparatus may further include a dosimeter configured to measure radiation dose and a radiation direction, the dosimeter being disposed in an emission side of the second collimator. For example, the dosimeter is an ion chamber (27).

According to this configuration, the ion chamber is disposed in the radioactive ray emission side. Therefore, dosimetric measurement can be performed during the swing operation of the second collimator. Also, the radiation direction of the radioactive ray can be measured with reference to radiation dose distribution.

(8) Preferably, a mass of a swing unit approximately coincide with a pivot of the swing unit, the swing unit is formed by the second collimator and components attached to the second collimator.

The swing unit does not swing on its own due to acceleration including the gravity because a central axis of rotation in the swing operation of a swing unit approximately coincides with center of mass of the swing unit. Also, in a case where the radiation therapy apparatus is mounted on a six-axial manipulator, the swing unit does not swing due to a movement of the six-axial manipulator even if the six-axial manipulator moves. Additionally, here, an expression "approximately coincide with" is used so as to cover a case where the mass does not perfectly coincide with the pivot. Also, for example, "components attached to the second collimator" includes a "swing mechanism", a "displacement amount detection unit", and "ion chamber".

Also, it is preferable that inertial moment about a rotation axis of a swing unit is evenly applied to respective components of swing unit, where the swing unit is made of the second collimator and components attached thereto. According to this configuration, torque fluctuation in the swing operation of the second collimator is reduced because the inertial moment about central axis of rotation is evenly applied to respective components of swing unit. Therefore, a stability of the mechanism is improved. Here, the components have been already described above.

(9) The collimator apparatus can be applied to a radiation therapy system.

In this case, the radiation therapy system determines a movement of a body part adjacent to the affected part based on two X-ray detection signal of X-ray detectors using at least two pairs of a X-ray tube for generating X-ray and a X-ray detector for planarly detecting the X-ray, where a marker for attenuating X-ray is embedded in the body part. According to the configuration, the movement of the body part adjacent to the affected part can be precisely detected based on detection signals of the two X-ray detectors.

(10) The swing operation of the second collimator may be performed by controlling the swing mechanism with the swing mechanism control unit of the collimator apparatus based on information indicating the movement of the body part adjacent to the affected part, in which the marker is embedded. The movement of the body can be detected through image processing (e.g., contour extraction) of moving bones, organs, etc., instead of the detection based on the movement of the marker.

(11) In another embodiment of the present disclosure, the radiation therapy system includes a X-ray head (100) and a manipulator (200) whose arm (210) can move in n-axial (wherein "n" is greater than or equal to 6) directions, the X-ray head including: an electron beam source (2) generating an electron beam; a target (4) converting the electron beam into radiation; a first collimator (10) configured to prevent a leakage of the radiation, the target being disposed inside the first collimator; a second collimator (20), the radiation passing through the second collimator along a central axis of the second collimator, the second collimator being disposed in an inner space formed in the first collimator, a gap between a surface of the inner space and the second collimator being provided; a swing mechanism (25) configured to cause the second collimator to swing within the inner space of the first collimator; and a swing mechanism control unit configured to control the swing mechanism, wherein the X-ray head is coupled to an end portion of the arm.

According to this aspect of the present disclosure, the X-ray head can be placed at a desired position when starting X-ray radiation because the manipulator can move an arm in six-axial directions, where the X-ray head is coupled to an end of the arm. Therefore, radiation exposure of healthy tissue can be avoided, and X-ray radiation therapy with fewer treatments and higher efficiency can be achieved.

(12) In another embodiment of the present disclosure, a method for controlling collimators is provided, wherein the first collimator of the collimators prevents a leakage of the radiation, an electron beam emitted from an electron beam gun being converted into the radiation by a target, the target being disposed inside the first collimator, and wherein the radiation passes through the second collimator along a central axis of the second collimator, the second collimator being disposed in an inner space formed in the first collimator, a gap being provided between a surface of the inner space and the second collimator, and the method includes causing the second collimator to swing within the inner space of the first collimator so as to irradiate a target irradiation field by the radiation passing through the second collimator. In this embodiment, also, the second collimator swings inside the first collimator.

Therefore, a X-ray radiation with precisely tracking the movement of the body can be performed.

(13) In another embodiment of the present disclosure, a program is provided. The program is for causing an apparatus to perform a method for controlling a swing mechanism, wherein the apparatus includes a first collimator configured to prevent a leakage of radiation, wherein a target for converting electron beam generated by an electron beam source into the radiation is disposed in the first collimator; a second collimator, wherein the radiation passes through the second collimator along a central axis of the second collimator, the second collimator being disposed in an inner space formed in the first collimator, a gap being provided between a surface of the inner space and the second collimator; and a swing mechanism configured to cause the second collimator to swing within the inner space of the first collimator.

According to the program, "control function" for controlling a swing mechanism for scan operation of the second collimator can be achieved, where the second collimator disposed in an inner space formed in the first collimator, and a gap is provided between a surface of the inner space and the second collimator. The swing operation is required only for the second collimator. Hence, the movement of the body can be tracked while the irradiation area of the object can be formed in a desired shape.

Reference numerals of units and elements illustrated in respective embodiments of the present disclosure are referred for clearly describing the present disclosure, and not for limiting the scope of claims.

In the following, embodiments of the present disclosure will be described in detail with reference to accompanying drawings. FIG. 1 is a diagram for schematically illustrating a radiation therapy process of the present embodiment of the disclosure using a radiation therapy system 1. For easy understanding of the present disclosure, first, an abstract of radiation therapy will be described with reference to FIG. 1. In the following, X-ray radiation is exemplified as the radiation.

<Schematic Radiation Therapy Process>

(A) One or more markers made of a material for attenuating the radiation, such as a gold marker G, are embedded in a body part adjacent to an affected part of a patient P who requires the radiation therapy. In FIG. 1, only one marker is illustrated for convenience of explanation. For example, the gold marker G is a spherical object made of gold (Au) whose diameter is approximate 1.5 mm. X-ray cannot transmit through the gold marker G since the X-ray is attenuated in the gold marker G. The affected part can be defined in a X-ray image according to the property of X-ray described above.

(B) After confirming that the gold marker G is fixed, CT (Computer Tomography) image data is obtained through CT capture of the patient P by using CT apparatus.

(C) A X-ray radiation therapy plan for the patient P based on the CT image data is created by using a therapy planning apparatus. Specifically, (C-1) ROI (Region of Interest) in an affected part and a target radiation dose distribution are input by an operator (e.g., doctor). (C-2) An optimistic radiation direction, an optimistic radiation dose, and a target moving path of X-ray head 100 (including important portion in the present disclosure) are calculated by a therapy planning software. The X-ray radiation therapy plan is created by defining the X-ray radiation direction, radiation dose, etc., with respect to the affected part of the patient P.

(D) An operator downloads the created therapy plan data into a general control console of a radiation therapy system 1.

(E) The patient P is laid on a couch 190 and a positioning operation is performed.

(F) The operator operates the radiation therapy system 1 to emit therapy X-ray incident on the patient P. At this time, the X-ray radiation is performed at optimized dose and direction in accordance with the therapy planning apparatus. Specifically, the six-axial manipulator 200 moves the X-ray head 100 up to a predetermined position. Further, "movement of surface of affected part (patient)/heartbeat/breathing phase" are respectively measured by "body surface monitoring camera/heartbeat monitoring apparatus/breathing phase monitoring apparatus" (not shown), thereby using the measurement results as data used in calculation for an operation control so as to compensate a movement of the affected part.

(G) The therapy operation is completed, and the patient P gets off from the couch 190, and leaves the treatment room.

The abstract of X-ray radiation therapy is explained by steps (A) to (G) described above.

However, in the step (F), the affected part may not be irradiated by the X-ray as expected in the created X-ray radiation therapy plan due to movement of the body of the patient P during the radiation. For example, in a case where the patient P has lung cancer and the affected part (lung cancer portion) in the lung is irradiated, a precise X-ray radiation is not performed because the affected part moves due to the breath of the patient P. Therefore, in an embodiment of the present disclosure, as described with reference to FIG. 2, a second collimator (secondary collimator 20) included in the X-ray head 100 preforms a swing operation in one direction or in two orthogonal directions (onedimensionally or two-dimensionally) within a first collimator (primary collimator) 10, and thereby continuously emits the X-ray tracking the moving affected part. A precise X-ray radiation can be achieved by performing moving body tracking.

In the X-ray radiation operation, the X-ray head 100 needs to be three-dimensionally moved by the six-axial manipulator 200 up to an appropriate position, and to be directed to an appropriate direction. Also, the second collimator (secondary collimator: see FIG. 2, etc.) 20 included in the X-ray head 100 needs to perform the swing operation. The X-ray head 100 is coupled to a front end of an arm 210 of the six-axial manipulator 200. The arm 210 is designed to be able to move in parallel with three axes and to rotate about the three axes. The X-ray head 100 can be moved up to a desired position and X-ray emitted from the X-ray head can be directed to a desired direction. The control apparatus 120 controls operations of the six-axial manipulator 200 and the position of the X-ray head 100. The control apparatus 120 includes an entire control unit 70 and a sub-controller 80. Operations thereof will be described below with reference to FIG. 7.

The radiation therapy system 1 includes a pair of X-ray tubes 50*a* and 50*b* and FPDs (Flat Panel Detector) 60*a* and 60*b* corresponding to the X-ray tubes 50*a* and 50*b*. Marker position detection X-rays emitted from the X-ray tubes 50*a* and 50*b* are respectively detected by corresponding FPDs 60*a* and 60*b*, and converted into digital signals. X-ray tubes 50*a* and 50*b* are provided, preferably, and not mandatorily, so that directions of respective emitted X-rays are made orthogonal. Respective X-ray detection images of the FPDs 60*a* and 60*b* includes a shadow corresponding to a gold marker G for attenuating the X-ray. For example, body movement position information of the affected part is calculated based on a center of the shadow of the gold marker G found by performing an image processing, etc., and based on CT image information. An irradiation field tracks the body movement by having the second collimator (secondary collimator 20) perform the swing operation based on the calculated body movement position information. Additionally, a control apparatus 120 illustrated in FIG. 1 collectively indicates control devices for performing operational control of the radiation therapy system 1, and the control apparatus includes the six-axial manipulator 200.

<Configuration of X-Ray Head 100>

Figure 2:
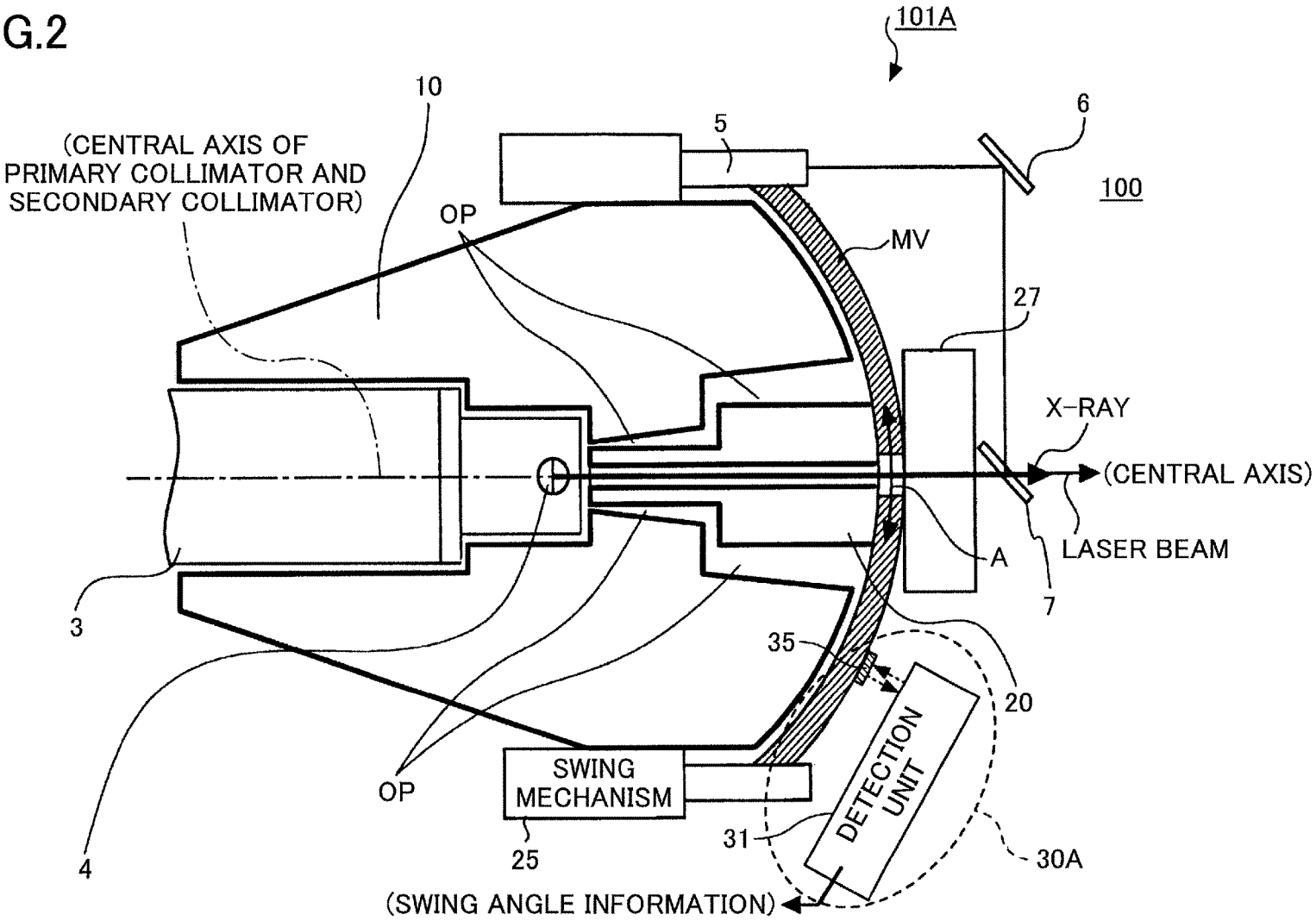
FIG. 2 is a diagram schematically illustrating important parts of an X-ray head.

FIG. 2 is a diagram schematically illustrating important parts of a X-ray generation part and an irradiation field formation part included in the X-ray head 100. At least a part of the X-ray head 100 forms a collimator apparatus 101A. The first collimator (primary collimator 10) has a central axis in a direction depicted by a dotted line in FIG. 2, and a shape of the first collimator is symmetric to the central axis. An acceleration tube 3, a target 4, etc., are arranged in the first collimator (primary collimator 10) so that a direction of the central axis of the first collimator (primary collimator 10) coincide with a forward direction of accelerated electron beam. Central axes of the acceleration tube 3 and the target 4 coincide with the central axis of the primary collimator 10. The second collimator (secondary collimator 20) is arranged in the first collimator (primary collimator 10), where gaps OP are provided between the second collimator and the first collimator. The second collimator has the X-ray pass along a central axis thereof. Additionally, in FIG. 2, a thick horizontal arrow extending from the target 4 indicates the emitted X-ray. Also, for example, the first collimator (primary collimator 10), the second collimator (secondary collimator 20), the target 4, etc., are made of metal material such as tungsten (W).

A dosimeter, e.g., an ion chamber 27 for measuring radiation dose of the X-ray is provided at an emission side of the second collimator (secondary collimator 20). Also, an aiming laser unit 5 for emitting visible-light (e.g., red light) laser beam is disposed on am member coupled to the second collimator (secondary collimator) 20. A direction of the visible-light laser beam emitted from the aiming laser unit 5 is set so as to coincide with the radiation direction of X-ray by using a mirror 6 and a mirror 7. Therefore, a position at which the X-ray is incident on can be recognized by observing a surface of the affected part on which the visible-light laser beam is incident.

Further, a swing mechanism 25 is provided for a movable member MV. The swing mechanism 25 moves a movable member MV, thereby having the second collimator (secondary collimator 20) coupled to the movable member MV swing in a direction depicted as an arrow A. The target 4 is positioned on the central axis of the second collimator (secondary collimator 20). For example, a bearing is provided between a spherical surface (whose center corresponds to target 4) of the first collimator (primary collimator 10) and the movable member MV coupled to the second collimator (secondary collimator 20). For example, the bearing is a coupling member including arc-like curved motion bearings for two directions so as to enable free movement in two directions. Thus, the movable member MV is held while a smooth swing operation about the target 4 can be performed by the second collimator (secondary collimator 20). Thus, radiation of the affected part can be precisely performed by controlling to drive the swing mechanism 25. Also, a swing angle detection unit 30A is provided as an example displacement amount detection unit. The swing angle detection unit 30A detects a displacement amount (swing angle) of the second collimator (secondary collimator 20) with respect to a reference position, thereby outputting the detection result as swing angle information.

<Swing Angle Detection Unit 30A>

Figure 4:
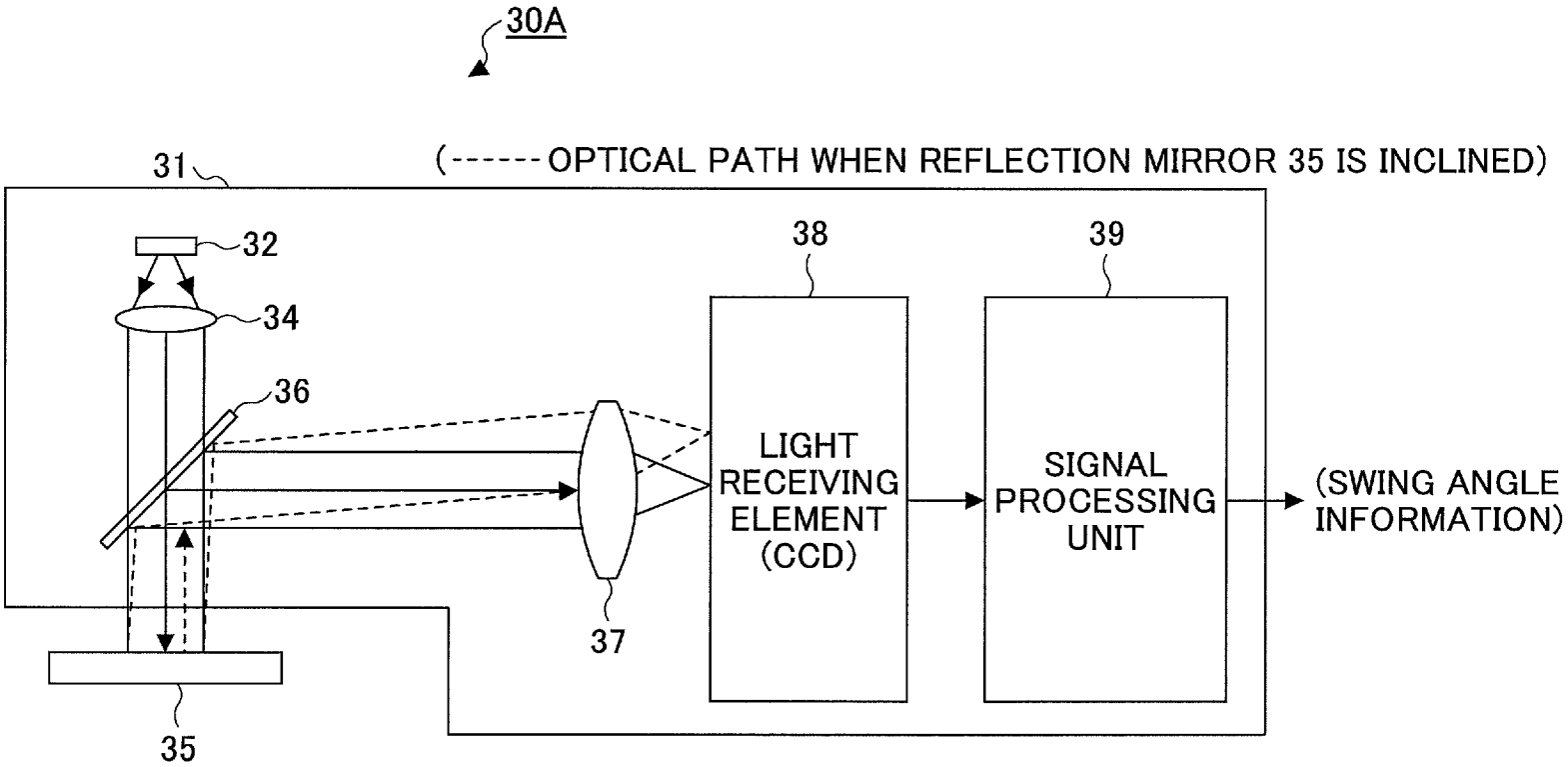
FIG. 4 is a diagram schematically illustrating a configuration of a swing angle detection unit.

FIG. 4 is a diagram schematically illustrating a configuration of the swing angle detection unit 30A. The swing angle detection unit 30A includes a detection unit 31 and a reflection mirror 35. As illustrated in FIG. 2, for example, the reflection mirror 35 is disposed on the movable unit MV. The visible-light laser beam emitted from a semiconductor laser 32 included in the detection unit 31 is collimated by a collimator lens 34 to pass through a half mirror 36, and reflected at a reflection mirror 35, and further reflected at a half mirror 36. The reflected light forms an image on a light receiving element 38, such as a CCD, through a light receiving lens 37. In FIG. 4, an optical path at a reference time (e.g., when the swing operation of the second collimator (secondary collimator 20) is not performed) is depicted by a solid line. In contrast, when the swing angle detection unit 30A is inclined, that is, the swing operation is performed, the optical path is moved, which is depicted as a dotted line, to move the image forming position on a light receiving element 38.

Figure 8:
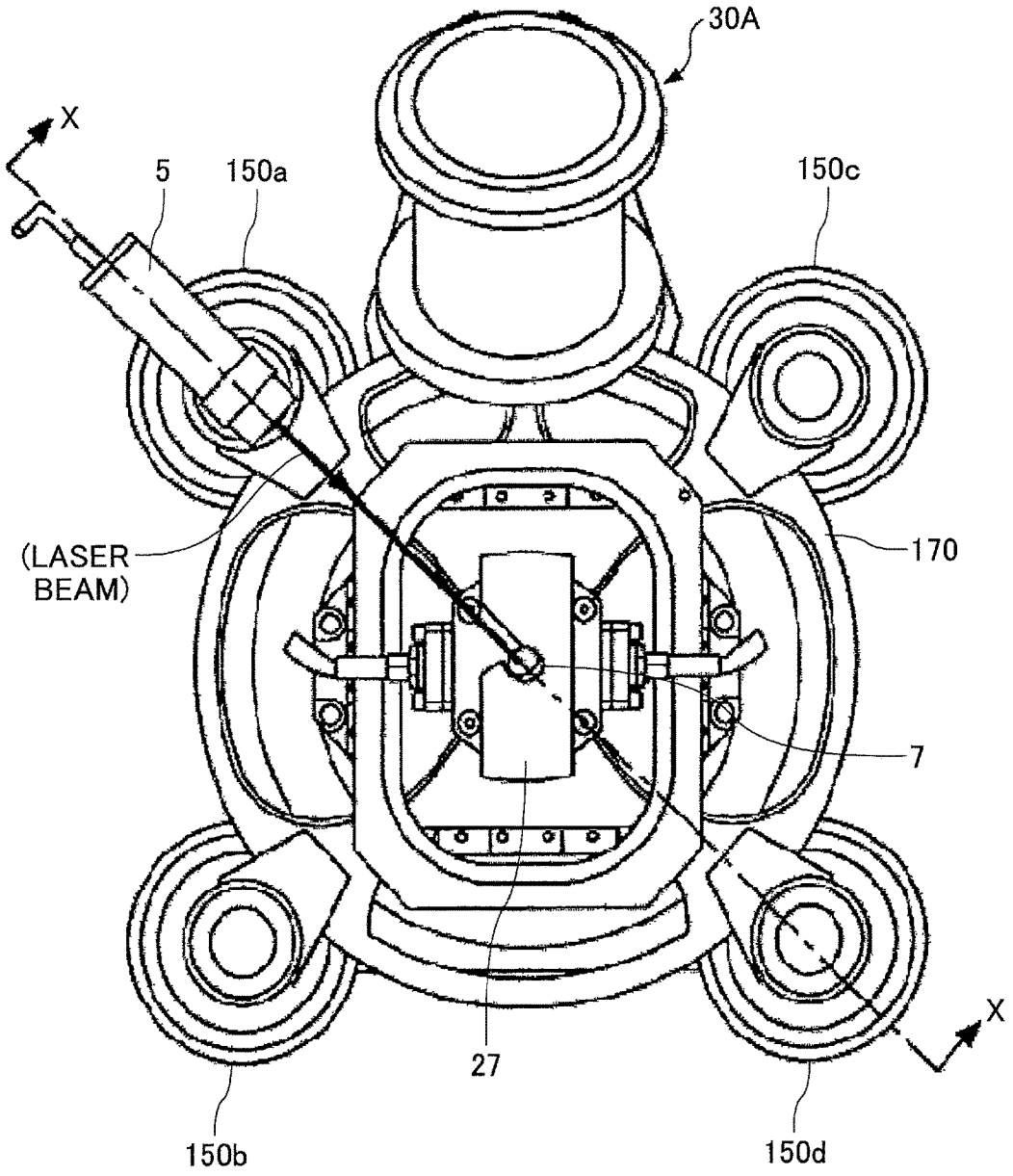
FIG. 8 is a front view of an X-ray radiation apparatus, in which the X-ray head is included.
Figure 9:
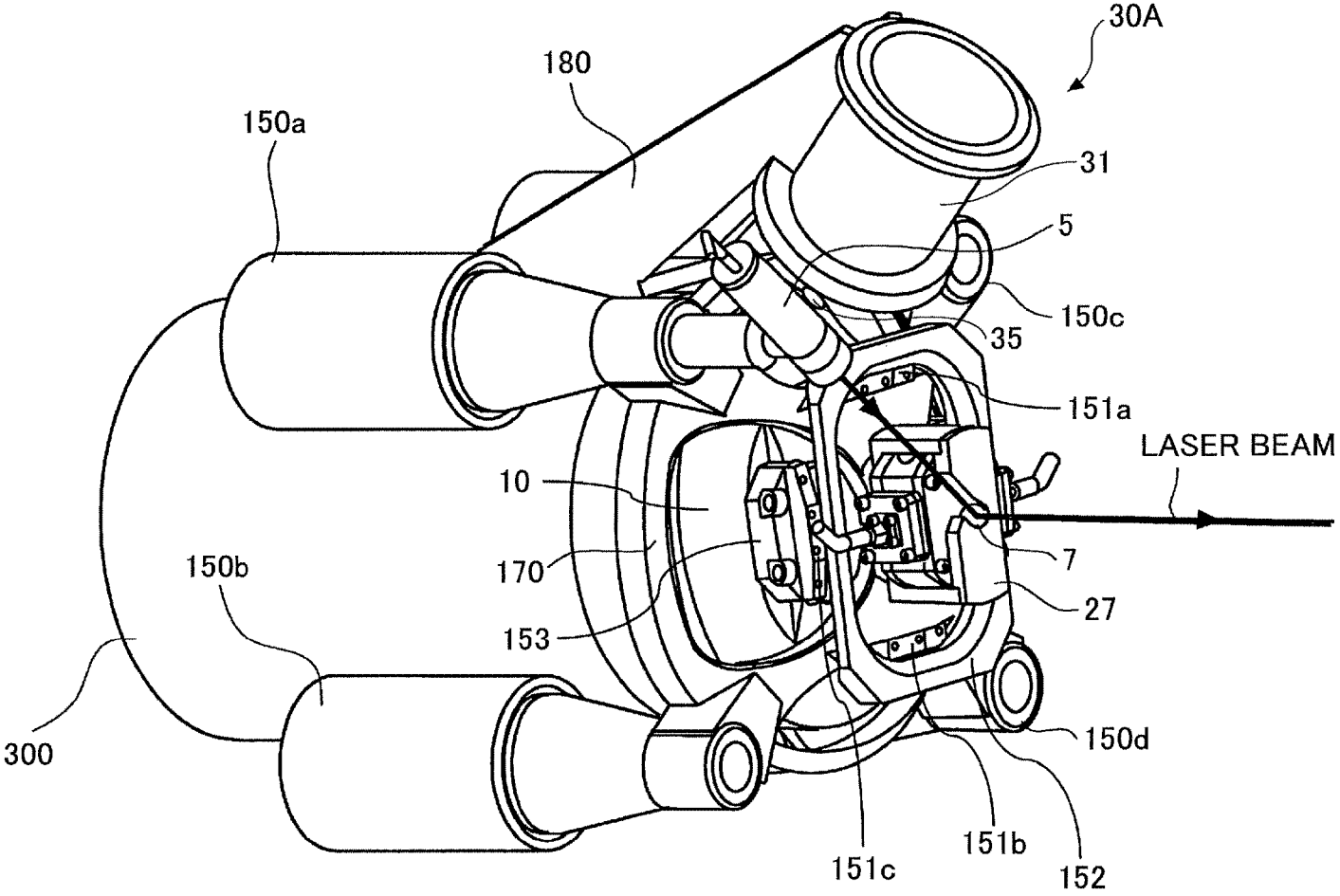
FIG. 9 is perspective view of the X-ray radiation apparatus, in which the X-ray head is included.
Figure 10:
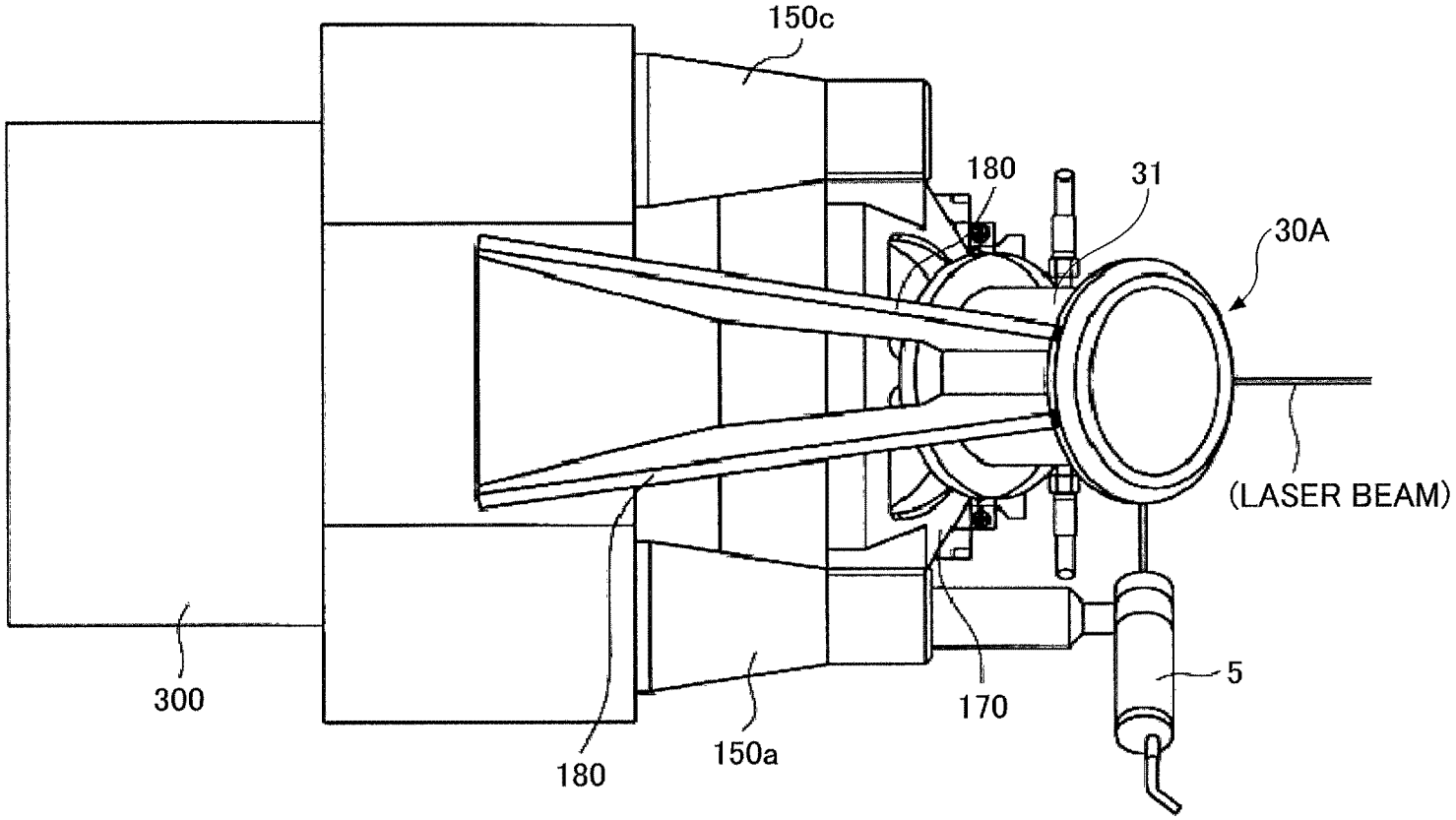
FIG. 10 is a plane view of the X-ray radiation apparatus, in which the X-ray head is included.

Specifically, when the swing angle detection unit 30A is inclined by angle "$\alpha$" with reference to a reference angle, the optical path depicted as a dotted line inclines by angle "$2\alpha$" with respect to the optical path depicted as the solid line, and the image forming position moves on a light receiving element 38. A signal processing unit 39 processes the signal from the light receiving element 38 to calculates incline of the swing angle detection unit 30A, and outputs information of swing angle. Information items indicating the image forming position on the light receiving element 38, etc., associated with the incline of the swing angle detection unit 30A may have been recorded in a table, and the incline of the swing angle detection unit 30A, that is, the swing angle of the second collimator (secondary collimator 20) is detected and output by determining an information item recorded in the table to which the received signal is closest. The above described configuration is preferable because a simple software/hardware configuration of the signal processing unit 39 can be adopted. The light output from the semiconductor laser 32 is collimated by the collimator lens 34. Therefore, an optical system can be achieved, in which image forming information of the light receiving element 38 is affected little even if the detection unit 31 moves in a normal direction of the reflection mirror 35. As illustrated in FIG. 8, FIG. 9, and FIG. 10, the detection unit 31 may be fixed at a X-ray head base 300 via a bracket 180, the reflection mirror 35 may be disposed on the movable member MV (a swing base 170 illustrated in FIG. 8), and other optical members (semiconductor laser 32, collimator lens 34, half mirror 36, and light receiving lens 37) and the light receiving element 38 of a CCD system may be disposed on a housing of X-ray head 100. The latter configuration has an advantage that a light-weight swing operation unit can be achieved. A CMOS sensor may be used as the light receiving element 38 instead of the CCD.

Referring back to FIG. 2, the electron beam emitted from an electron gun 2 (see FIG. 3) is accelerated in the acceleration tube 3 to collide against the target 4, and the electron beam is converted into the X-ray consequently. An irradiation field of the X-ray generated by the target 4 is narrowed by the second collimator (secondary collimator 20), thereby forming a desired irradiation field with respect to the affected part. Further, outside leakage of X-ray generated by the target 4 can be suppressed by the first collimator (primary collimator 10).

The movable member MV moves in both directions depicted as a double-headed arrow A (vertical direction in FIG. 2) by controlling the swing mechanism 25 to drive. Therefore, the second collimator (secondary collimator 20) performs the swing operation in the vertical direction in FIG. 2. The displacement amount (swing angle) that is a swing amount with respect to a reference position is detected by the swing angle detection unit 30. For example, the detected swing amount is fed-backed in performing the swing operation, thereby achieving a stability of control operation. Additionally, not only the swing operation in the vertical direction (one-dimensional action, or one-directional action) in FIG. 2 but also the swing operation of the second collimator (secondary collimator 20) in a direction perpendicular to the paper surface (depth direction in FIG. 2) can be achieved by moving the movable element MV in the depth direction in FIG. 2.

That is, two-directional (two-dimensional) swing operation of the second collimator (secondary collimator 20) can be achieved. The two-dimensional swing operation can be also achieved by providing swing mechanisms dedicated for respective directions. Also, the displacement amount can be detected by one swing angle detection unit 30 or by swing angle detection units 30 dedicated for respective directions. Further, for example, when one or more voice coil motors are used as the swing mechanism 25, the swing operation can be achieved with high speed and high precision. As described above, the X-ray head 100 includes the electron gun 2, the acceleration tube 3, the target 4, the aiming laser unit 5, the first collimator (primary collimator 10), the second collimator (secondary collimator 20), the swing mechanism 25, the swing angle detection unit 30, an in-X-ray head controller 90 (see FIG. 5), etc., as main components thereof.

<X-Ray Generation Unit>

Figure 3:
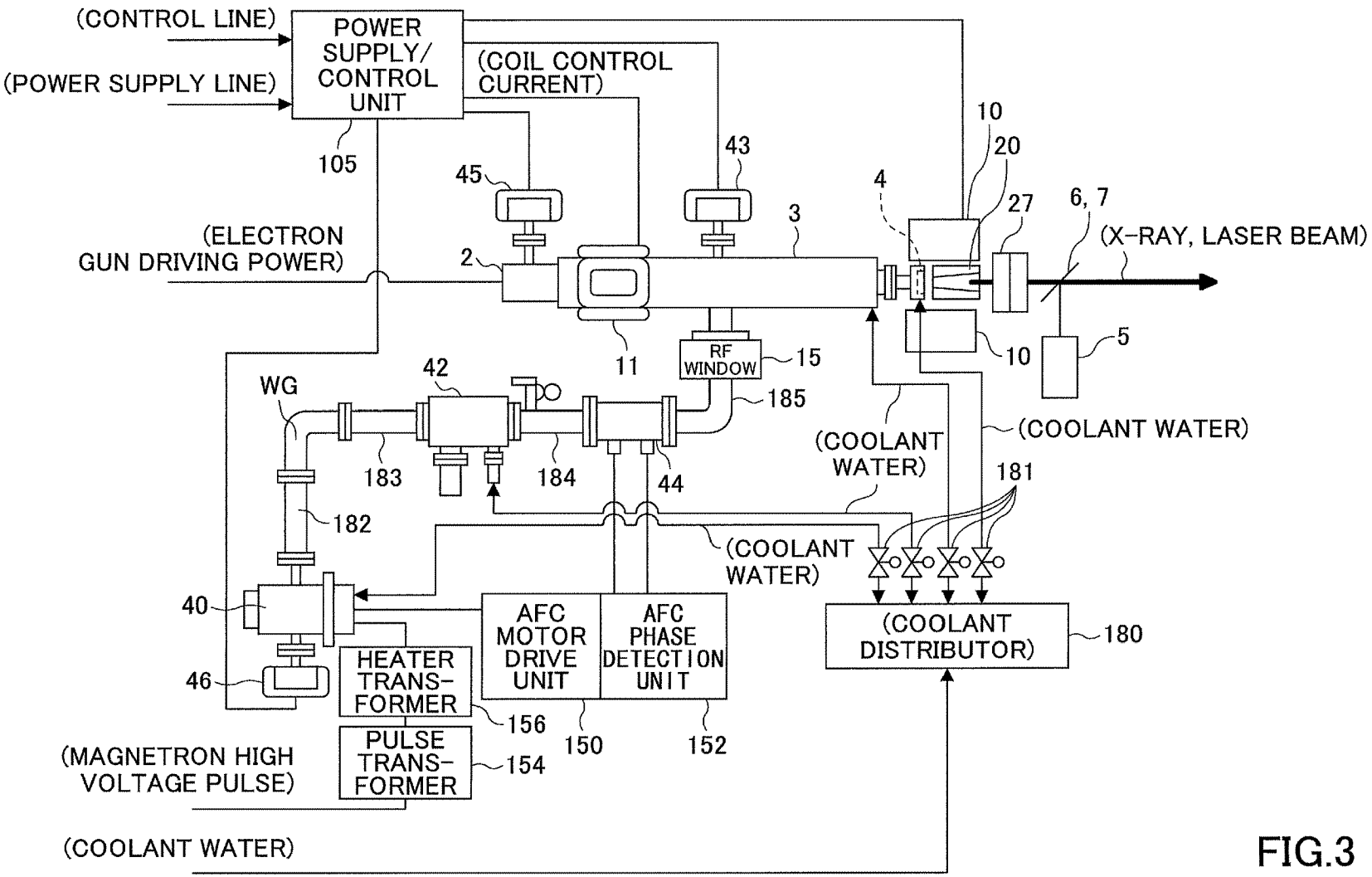
FIG. 3 is a diagram schematically illustrating a configuration of an X-ray generation unit.

FIG. 3 is a diagram schematically illustrating a configuration inside the X-ray head 100, especially, a generation unit of the electron beam, an acceleration unit of the electron beam, and X-ray generation unit. A power supply/control unit 105 supplies electric power to respective portions, and provides control signals. Electron gun driving power is supplied to the electron gun 2, where an ion pump 45 is driven to make inside of the electron gun 2 be in vacuum atmosphere. The acceleration tube 3 accelerates the electron beam emitted from the electron gun 2 therein. Inside the acceleration tube 3 is vacuum atmosphere due to an operation of an ion pump 43. The steering coil 11 is a coil for applying magnetic field so as to slightly adjust an acceleration direction of the electron beam.

The target 4 is embedded adjacent to an end (right end in FIG. 3) of the acceleration tube 3. The target 4 is an electron beam to X-ray conversion means because the target 4 generates the X-ray upon the electron beam colliding against the target 4. As described above, the irradiation field of the generated X-ray is narrowed into a desired irradiation field through the second collimator (secondary collimator 20) performing the swing operation. In FIG. 3, the visible-light laser beam emitted from the aiming laser unit 5 is guided by mirrors 6 and 7 (see FIG. 2) so that an axis of the X-ray (central axis of forwarding direction of X-ray) coincide with a light axis of the laser beam (central axis of the laser beam). Coolant water from a coolant distributor 180 is provided to respective portions, where amount of coolant water is adjusted by flow amount adjustment valve. Especially, the coolant water at a constant temperature is provided for the target 4, the acceleration tube 3, a magnetron 40, a circulator 42, and the like.

Upon a magnetron high voltage pulse being supplied to a pulse transformer 154, the high voltage of the pulse transformer 154 is applied to the magnetron 40 via a heater transformer 156, and the magnetron 40 generates and outputs a high-frequency electromagnetic wave. Additionally, an operation of an ion-pump 46 causes vacuum atmosphere in the vicinity of the magnetron 40.

The electromagnetic wave generated and output by the magnetron 40 passes through waveguide devices such as an E-vent, a flexible waveguide, the circulator 42, a H-vent, and a coupler 44, and the electromagnetic wave is introduced into the acceleration tube 3 via a RF window 15. An AFC phase detection unit 152 detects phase difference between a travelling wave and reflected wave guided in the waveguide devices by using a terminal 2 of the coupler 44. An AFC motor drive unit 150 coupled to a cavity of magnetron 40 controls a size of a cavity in accordance with the detected phase difference, and thereby changes an oscillation frequency. As a consequence, AFC (Auto Frequency Control), that is, a frequency stabilization control by feeding-back deviation of frequency of electromagnetic field is performed.

Upon the high-frequency electromagnetic wave being introduced from the RF window 15, an electronic field appropriate for acceleration is formed along a central axis of the acceleration tube 3, thereby accelerating the electron beam. That is, the electron beam emitted from the electron gun 2 collides against the target 4 to generate the X-ray, where the electron beam is accelerated by the high-frequency electromagnetic field generated by introducing the electromagnetic wave into the acceleration tube 3. Additionally, in Japanese Unexamined Patent Application Publication No. 2008-198522, principles of such an X-ray generation unit (lineac type), etc., are disclosed. Also, it is confirmed that high energy X-ray with a small spot diameter can be generated when a spot diameter of the electronic beam emitted toward the target 4 is equal to or less than 1 mm, and the target 4 includes a collimator having a X-ray guide hole (whose diameter is equal to or less than 0.6 mm).

<Configuration of Control System>

Figure 5:
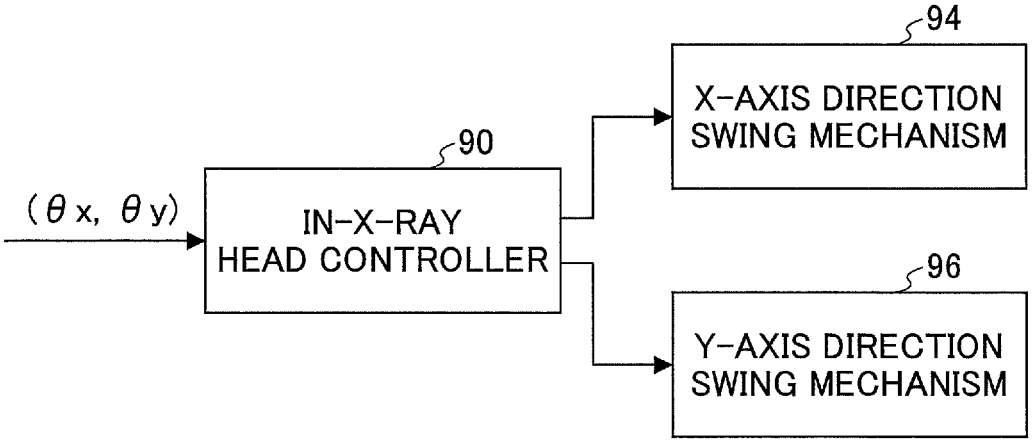
FIG. 5 is a basic block diagram illustrating a swing control.
Figure 6:
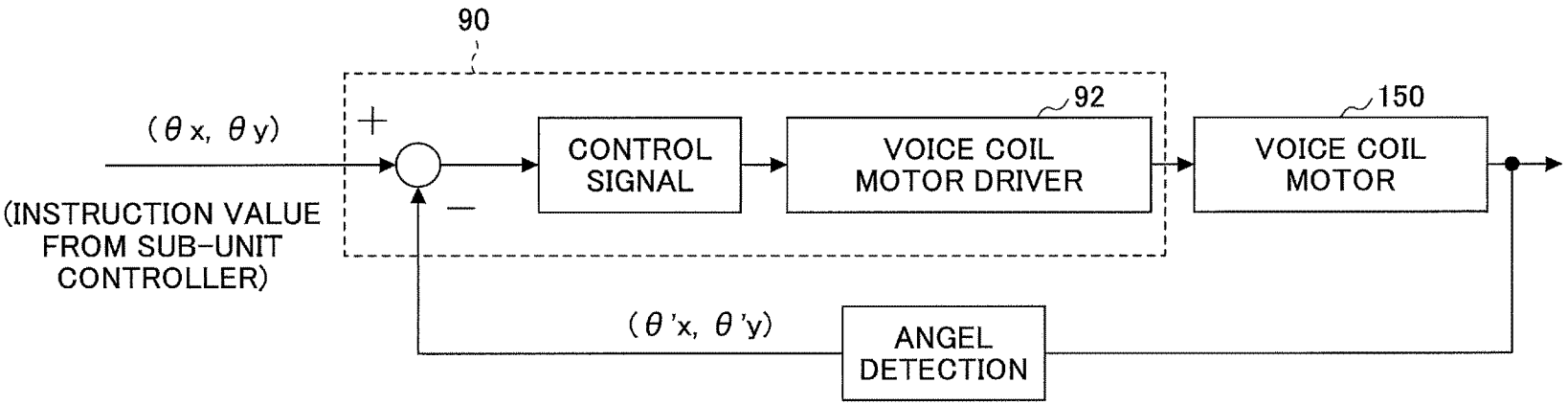
FIG. 6 is a diagram illustrating a FB control of swing control.
Figure 7:
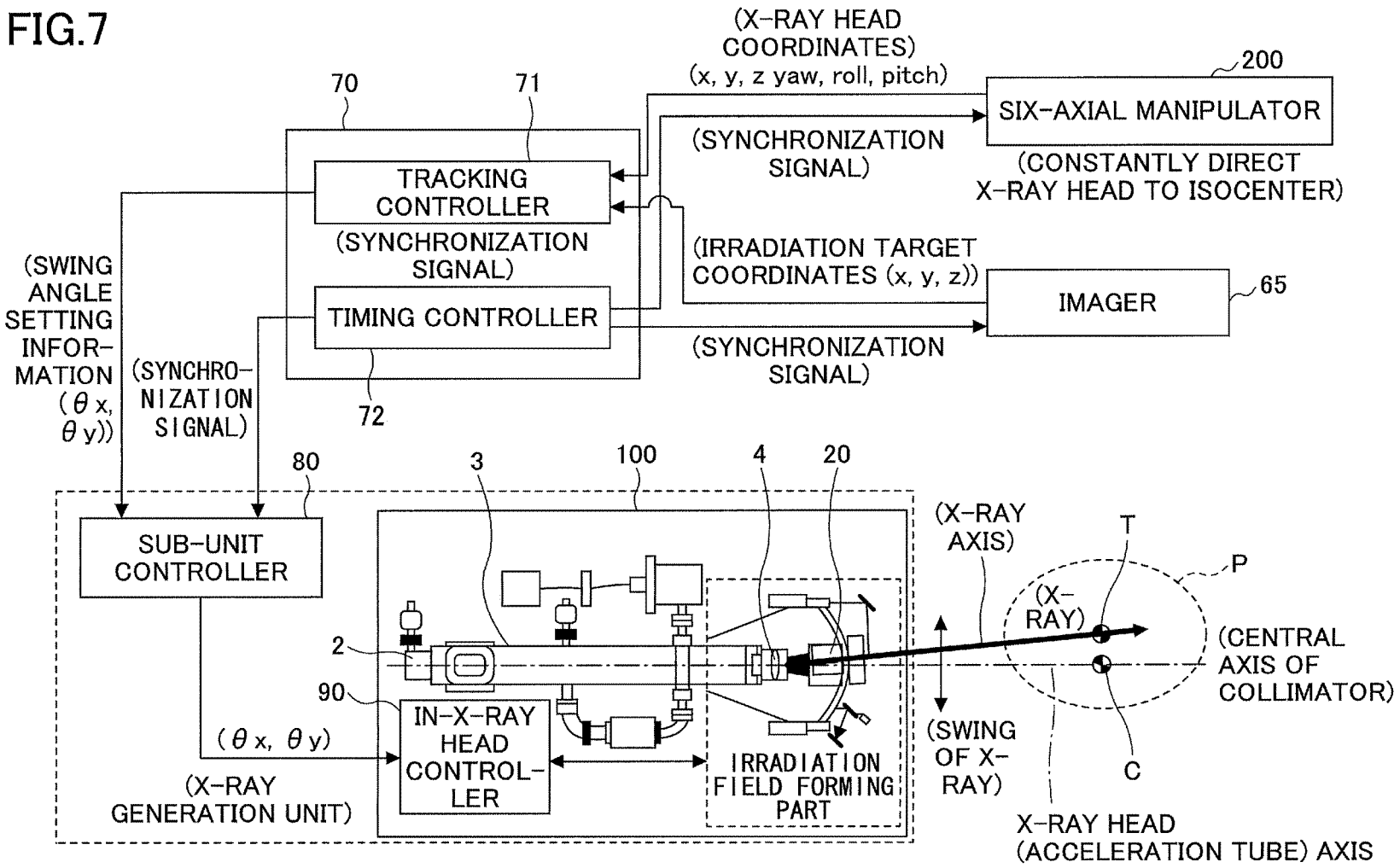
FIG. 7 is a block diagram illustrating the swing control.

FIG. 5 is a basic block diagram of X-ray head 100. FIG. 6 is a diagram illustrating a basic principal of swing control. FIG. 7 is a block diagram schematically illustrating the swing control in the entire radiation therapy system 1. As illustrated in FIG. 5, in response to information indicating a two-dimensional swing angle (θx, θy) of the second collimator (secondary collimator 20) being provided, the in-X-ray head controller 90 gives instructions to a X-axis direction swing mechanism 94 and a Y-axis direction swing mechanism 96. Consequently, the X-axis direction swing mechanism 94 and the Y-axis direction swing mechanism 96 are respectively controlled to be driven so that the second collimator (secondary collimator 20) is at a position where the swing angles in the X-axis direction and the Y-axis direction are (θx, θy). This is a basic configuration of the control system.

As illustrated in FIG. 6, a voice coil motor driver 92 of the in-X-ray head controller 90 controls the voice coil motor 150 in accordance with the generated control signal to perform the swing operation. The swing angle is detected by the swing angle detection unit 30A. The detected swing angle is compared with an angle instruction value given from a sub-unit controller 80, and the feedback control is performed so that deviation detected by the comparison is absorbed. According to the above described configuration, control stability is improved.

FIG. 7 is a diagram illustrating an example control system of the radiation therapy system 1. An entire control unit 70 includes a tracking controller 71 and a timing controller 72. The timing controller 72 generates a synchronization signal for synchronizing devices in the system, and provides the generated synchronization signal to the six-axial manipulator 200, an imager 65, a sub-unit controller 80, and the like. Additionally, the imager 65 is a device for obtaining an X-ray image, which is formed of a combination of the X-ray tube 50 and the FPD 60 (a combination of the X-ray tube 50*a* and the FPD 60*a* and a combination of the X-ray tube 50*b* and the FPD 60*b*) illustrated in FIG. 1. Coordinates (x, y, z, yaw, roll, pitch) of the X-ray head 100 are provided from the six-axial manipulator 200 to the tracking controller 71.

The six-axial manipulator 200 is operated so as to constantly direct the X-ray head 100 to an isocenter (center point of therapy). Here, a coordinate system is defined, in which the isocenter corresponds to the origin, two directions in a horizontal plane respectively correspond to a X-axis and a Y-axis, and a vertical direction corresponds to a Z-axis. "Yaw" indicates a rotational amount about the z-axis, "roll" indicates a rotational amount about the x-axis, and "pitch" indicates a rotational amount about the y-axis. Also, a coordinate (x, y, z) of irradiation target is provided from the imager 65 to the tracking controller 71. The sub-unit controller 80 receives swing angle setting information (θx, θy) from the tracking controller 71 to provide the setting information to the in-X-ray head controller 90 included in the X-ray head 100.

<Control Operation>

(1) The tracking controller 71 of the entire control unit 70 receives the coordinate (x, y, z, yaw, roll, pitch) of the X-ray head 100 from the six-axial manipulator 200. The tracking controller 71 receives the coordinate (x, y, z) of the irradiation target from the imager 65. The tracking controller 71 calculates an ideal swing angle of the second collimator (secondary collimator 20) based on the received current coordinates of the X-ray head 100 and the coordinates of the irradiation target. (2) The tracking controller 71 of the entire control unit 70 transmits the calculated swing angle to the sub-unit controller 80 of the X-ray generation unit as the swing angle setting information. The sub-unit controller 80 transmits the received swing angle setting information to the in-X-ray head controller 90 included in the X-ray head 100. (3) The in-X-ray head controller 90 receives the swing angle setting information to perform a calculation processing for feed-back control, and provides the received swing angle setting information to the swing mechanism 25 via a driver circuit. The swing mechanism 25 moves the second collimator (secondary collimator 20) so that the second collimator (secondary collimator 20) is at a position with the swing angle indicated by the received swing angle setting information. Additionally, in FIG. 7, "irradiation field forming part" in the X-ray head 100 has a function to form the irradiation field, and includes the first collimator (primary collimator 10), the second collimator (secondary collimator 20), and the swing mechanism 25.

By repeating the above described operations (1)-(3), the X-ray axis is constantly directed to the irradiation target. Therefore, an appropriate X-ray radiation on the affected part can be achieved through the swing operation even if the movement of the body occurs. Thus, as depicted as a thick line described in right lower side of FIG. 7, the X-ray axis tracks the irradiation target T (irradiation target in affected part) of the patient P even if a position of the target T sifts from a reference collimator central axis by performing swing operation (up-down direction in FIG. 7) of the collimator. The set of above-described operations are performed in accordance with the synchronization signal generated and output from the timing controller 72 of the entire control unit 70. Therefore, a high speed tracking operation can be performed.

<Image Processing>

Figure 16A:
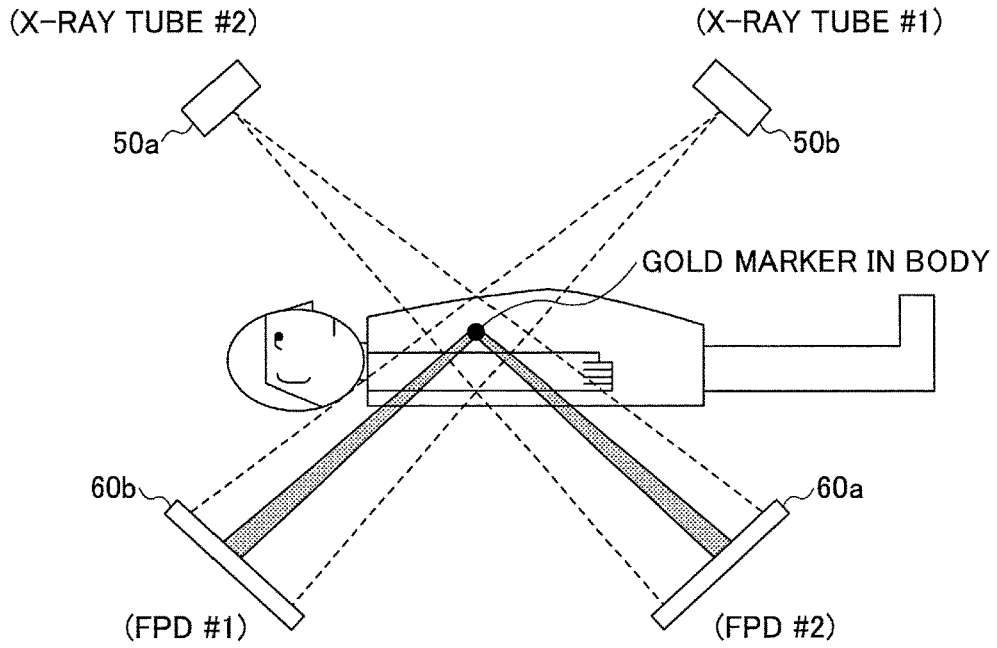
FIG. 16A is a diagram illustrating principal of X-ray fluoroscopic photographing.
Figure 16B:
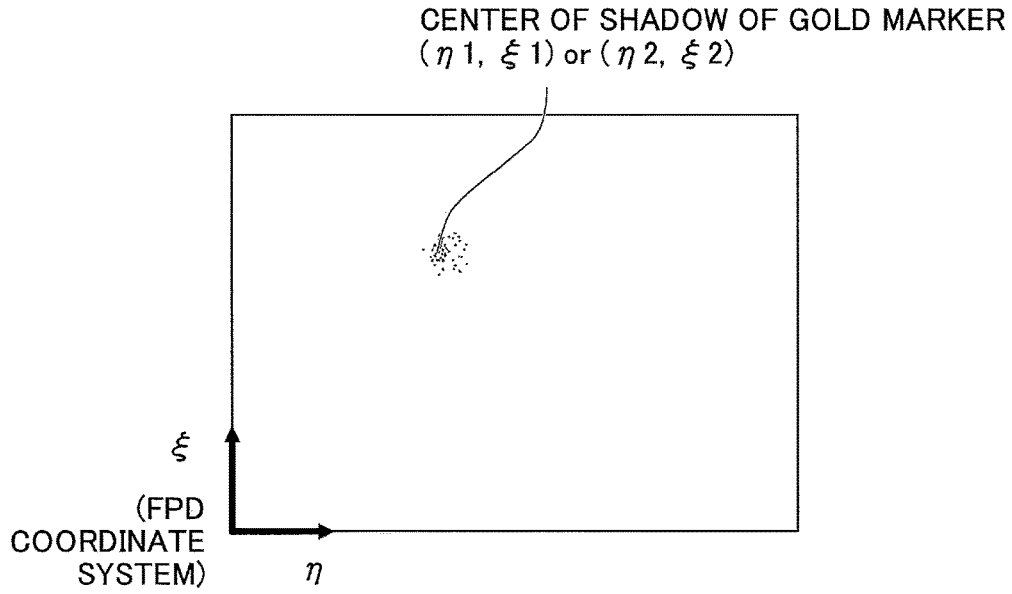
FIG. 16B is a diagram illustrating an example X-ray image detected by FPDs.

An image processing operation of the imager 65 will be described with reference to FIG. 16A to FIG. 173. FIG. 16A is a diagram illustrating principal of X-ray fluoroscopic photographing. A cancer affected part cannot be directly seen in the X-ray fluoroscopic image because contrast between normal tissue and cancer affected part is significantly small in the X-ray fluoroscopic image. Therefore, a gold marker G whose diameter is approximate 1.5 mm is inserted in a body part adjacent to the cancer affected part, and the gold marker G is observed. Two combinations of X-ray tube and FPD (a combination of X-ray tube 50*a* and FPD 60*a* and a combination of X-ray tube 50*b* and FPD 60*b*) are provided. Preferably, the X-ray axes (central axes in X-ray forwarding direction) of respective X-ray tubes 50*a* and 50*b* intersect orthogonally. However, this is not a limiting example. FIG. 16B is a diagram illustrating an example X-ray image detected by the FPD 60*a* and the FPD 60*b*. A central coordinates of the gold marker G can be obtained in a coordinate system ((η, ξ) coordinate system) of the FPD by analyzing the X-ray image. Additionally, in the following, an example image processing performed by using two combinations of X-ray tube and FPD is described. However, the image processing may be performed by using three or more combinations of X-ray tube and FPD.

A three dimensional coordinate (x, y, z) that indicates the central position of the gold marker G can be obtained based on four coordinates (η1, ξ1) and (η2, ξ2) in two images. That is, the three dimensional coordinate (x, y, z) can be expressed as follows.

$$(x,y,z)=f(\eta 1,\xi 1,\eta 2,\xi 2)$$

The coordinate of the gold marker G can be precisely measured by appropriately defining function "f" and finally performing a calibration for adjustment. Information required in an actual therapy is not the coordinate of the gold marker G, but a coordinate of the cancer affected part. A positional relationship between the gold marker G and the cancer affected part is defined in the therapy plan by using a CT image in advance. For example, a coordinate (x1, y1, z1) of the cancer affected part can be expressed as follows by using the coordinate (x0, y0, z0) of the gold marker G.

$$x1=x0+a, y1=y0+b, z1=z0+c$$

Figure 17B:
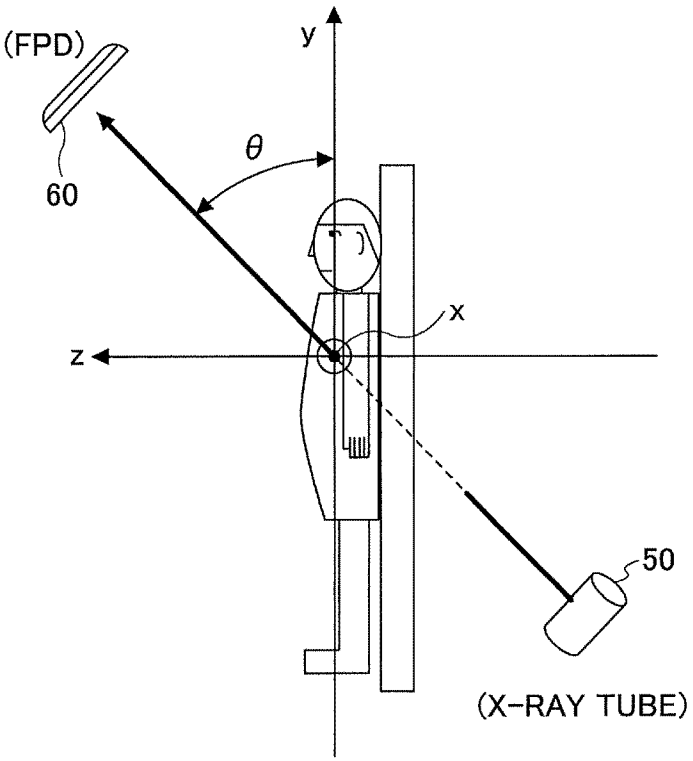
FIG. 17B is another diagram illustrating an example arrangement of imagers.
Figure 17A:
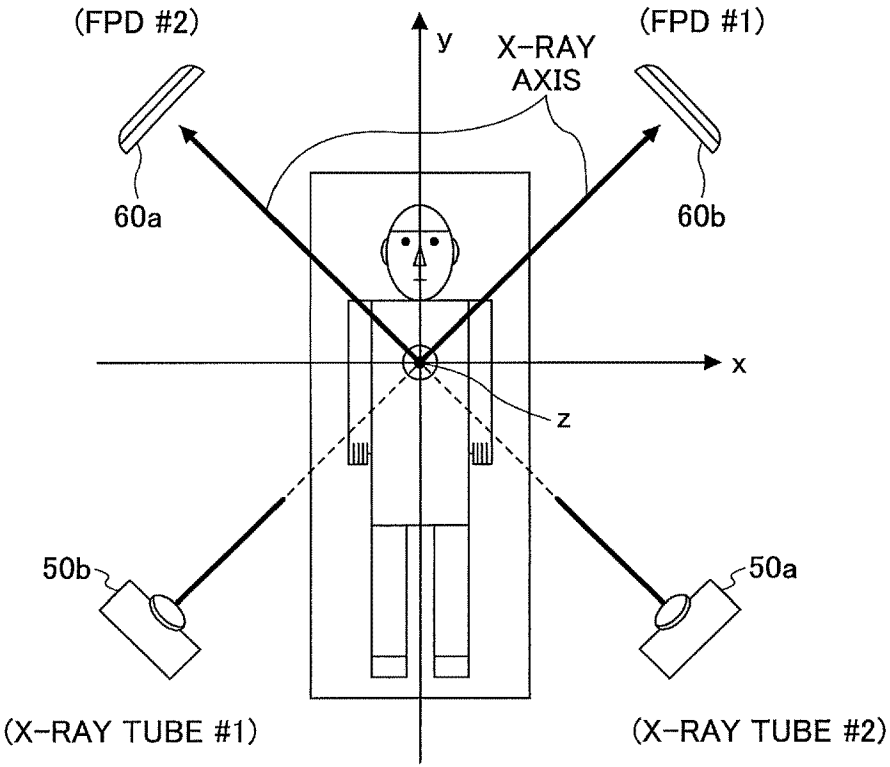
FIG. 17A is a diagram illustrating an example arrangement of imagers.

In the following, an example algorithm for calculating the coordinate (target coordinate) of the gold marker G by using the imager 65 will be described. Principally, the coordinate of position is calculated based on stereo images obtained by imagers 65 including the X-ray tube 50 and the FPD 60. An arrangement of the X-ray tubes (50*a*, 50*b*) and the FPDs (60*a*, 60*b*) is important for defining the algorithm. Specifically, the imagers 65 are arranged as illustrated in FIG. 17A and FIG. 17B. As illustrated in FIG. 17A and FIG. 17B, the Z-axis is defined in a vertical direction, where the isocenter C of the treatment room is the origin. Also, the X-axis and the Y-axis are defined so as to be orthogonal to the Z axis. The following parameters are important.

"orthogonality": X-ray axes are preferably orthogonal to each other, where the X-ray axes are straight lines connecting focal points of X-ray tubes 50*a* and 50*b* and centers of FPDs 60*a* and 60*b*.

"planar symmetry": the X-ray tubes (50*a*, 50*b*) and the FPDs (60*a*, 60*b*) are arranged so as to be symmetrical with respect to a yz plane of coordinate system of the treatment room.

"coordinate axis of FPD": n axis of FPD image is in a FPD plane intersects with a plane (imager plane) formed by a pair of X-ray axes, while axis is also in the FPD plane and ξ axis is orthogonal to η axis.

"elevation angle": angle θ between a plane formed by a pair of X-ray axes and the xy plane of coordinate system of the treatment room is referred to as "imager elevation angle".

"magnification rate": ratio of a first distance and a second distance is "1: α". Here, the first distance is a distance between a X-ray generation point of the X-ray tube and the gold marker G, while the second distance is a distance between a X-ray generation point of the X-ray tube and a point on the FPD plane, where a straight line connecting the X-ray generation point of the X-ray tube and the gold marker G passes through the point on the FPD plane. This means a magnification rate on the FPD image.

The orthogonality and the planar symmetry are preferable and not mandatory.

Formula (1) shown below is given, wherein a position of the affected part is expressed by x upper-bar, y upper-bar, and z upper-bar (the "upper-bar" means a bar-shaped mark depicted over characters "x", "y", and "z".)

Relationship between the coordinate (x, y, z) of the cold marker G in the coordinate system of the treatment room and coordinates [($\eta_1$, ξ1), (η2, ξ2)] in FPD coordinate system can be expressed as formula (2) shown below, by using a rotation matrix (Rx, Rz) and a magnification rate α.

[math. 1]

$$\begin{bmatrix} \bar{x} \\ \bar{y} \\ \bar{z} \end{bmatrix} = \begin{bmatrix} x+a \\ y+b \\ z+c \end{bmatrix} \tag{1}$$

$$\begin{bmatrix} \eta_1 \\ \xi_1 \\ \eta_2 \\ \xi_2 \end{bmatrix} = AR_zR_x \begin{bmatrix} x \\ y \\ z \end{bmatrix} \tag{2}$$

Wherein, a distance (square root of (X2+Y2+Z2)) between the isocenter and the gold marker G is small enough in comparison to a distance between the X-ray tube and the isocenter, or the FPD and the isocenter. That is, the magnification rate α is approximated as a ratio of a distance between the generation point of the X-ray tube and the isocenter to a distance between the generation point of the X-ray tube and the center of FPD. Here, Matrixes shown as (3) to (5) are used.

[math. 2]

$$A = \begin{bmatrix} \alpha & 0 & 0 & 0 & 0 & 0 \\ 0 & 0 & \alpha & 0 & 0 & 0 \\ 0 & 0 & 0 & \alpha & 0 & 0 \\ 0 & 0 & 0 & 0 & 0 & \alpha \end{bmatrix} \tag{3}$$

$$R_z = \begin{bmatrix} \cos(\pi/4) & -\sin(\pi/4) & 0 \\ \sin(\pi/4) & \cos(\pi/4) & 0 \\ 0 & 0 & 1 \\ \cos(\pi/4) & \sin(\pi/4) & 0 \\ -\sin(\pi/4) & \cos(\pi/4) & 0 \\ 0 & 0 & 1 \end{bmatrix} \tag{4}$$

$$R_x = \begin{bmatrix} 1 & 0 & 0 \\ 0 & \cos\theta & \sin\theta \\ 0 & -\sin\theta & \cos\theta \end{bmatrix} \tag{5}$$

These matrixes are organized as (6) shown below.

[math. 3]

$$M = AR_zR_x = \begin{bmatrix} \frac{\alpha}{\sqrt{2}} & -\frac{\alpha\cos\theta}{\sqrt{2}} & -\frac{\alpha\sin\theta}{\sqrt{2}} \\ 0 & -\alpha\sin\theta & \alpha\cos\theta \\ \frac{\alpha}{\sqrt{2}} & \frac{\alpha\cos\theta}{\sqrt{2}} & \frac{\alpha\sin\theta}{\sqrt{2}} \\ 0 & -\alpha\sin\theta & \alpha\cos\theta \end{bmatrix} \tag{6}$$

Consequently, matrix equation (7) shown below is to be solved.

[math. 4]

$$\begin{bmatrix} \eta_1 \\ \xi_1 \\ \eta_2 \\ \xi_2 \end{bmatrix} = M \begin{bmatrix} x \\ y \\ z \end{bmatrix} \tag{7}$$

Here, unknowns (x, y, z) are calculated based on observables (η1, ξ1, η2, ξ2). Normally, solution cannot be found when there are three unknowns with respect to four equations. Therefore, least-square method is used. Thus, normal equation as shown as formula (8) can be defined. Wherein, x, y, and z shown in formula (8) respectively indicate solutions of the least-square method.

[math. 5]

$$M^T\begin{bmatrix}\eta_1\\ \xi_1\\ \eta_2\\ \xi_2\end{bmatrix} = M^T M\begin{bmatrix}x\\ y\\ z\end{bmatrix} \tag{8}$$

These simultaneous equations can be simply solved as shown as formula (9) shown below.

[math. 6]

$$\begin{bmatrix}x\\ y\\ z\end{bmatrix} = (M^T M)^{-1} M^T\begin{bmatrix}\eta_1\\ \xi_1\\ \eta_2\\ \xi_2\end{bmatrix} = \begin{bmatrix}\frac{1}{\sqrt{2}\,a} & 0 & \frac{1}{\sqrt{2}\,a} & 0\\ -\frac{\cos\theta}{\sqrt{2}\,a} & -\frac{\sin\theta}{2a} & \frac{\cos\theta}{\sqrt{2}\,a} & -\frac{\sin\theta}{2a}\\ -\frac{\sin\theta}{\sqrt{2}\,a} & \frac{\cos\theta}{2a} & \frac{\sin\theta}{\sqrt{2}\,a} & \frac{\cos\theta}{2a}\end{bmatrix}\begin{bmatrix}\eta_1\\ \xi_1\\ \eta_2\\ \xi_2\end{bmatrix} \tag{9}$$

By calculating formula (9), the coordinate of the gold marker G in the coordinate system of the treatment room can be obtained based on the coordinate of the gold marker G in the coordinate system of imager. The cancer affected part can be expressed by (x+a, y+b, z+c) according to formula (1). As described above, a coordinate of irradiation target can be obtained from an imager coordinate through image processing, and the like.

By the way, a coordinate of the X-ray generation point (target 4) of X-ray head is given as (Xs, Ys, Zs). Following conversion equations can be defined by using coordinate (r, θ, φ) in polar coordinate system. Wherein "r" is referred to "SAD", which is a constant value during therapy operation, and "θ" does not mean the elevation angle, here.

[math. 7]

$$x_s = r\sin\theta\cos\varphi$$

$$y_s = r\sin\theta\sin\varphi$$

$$z_s = r\cos\theta \tag{10}$$

Figure 18:
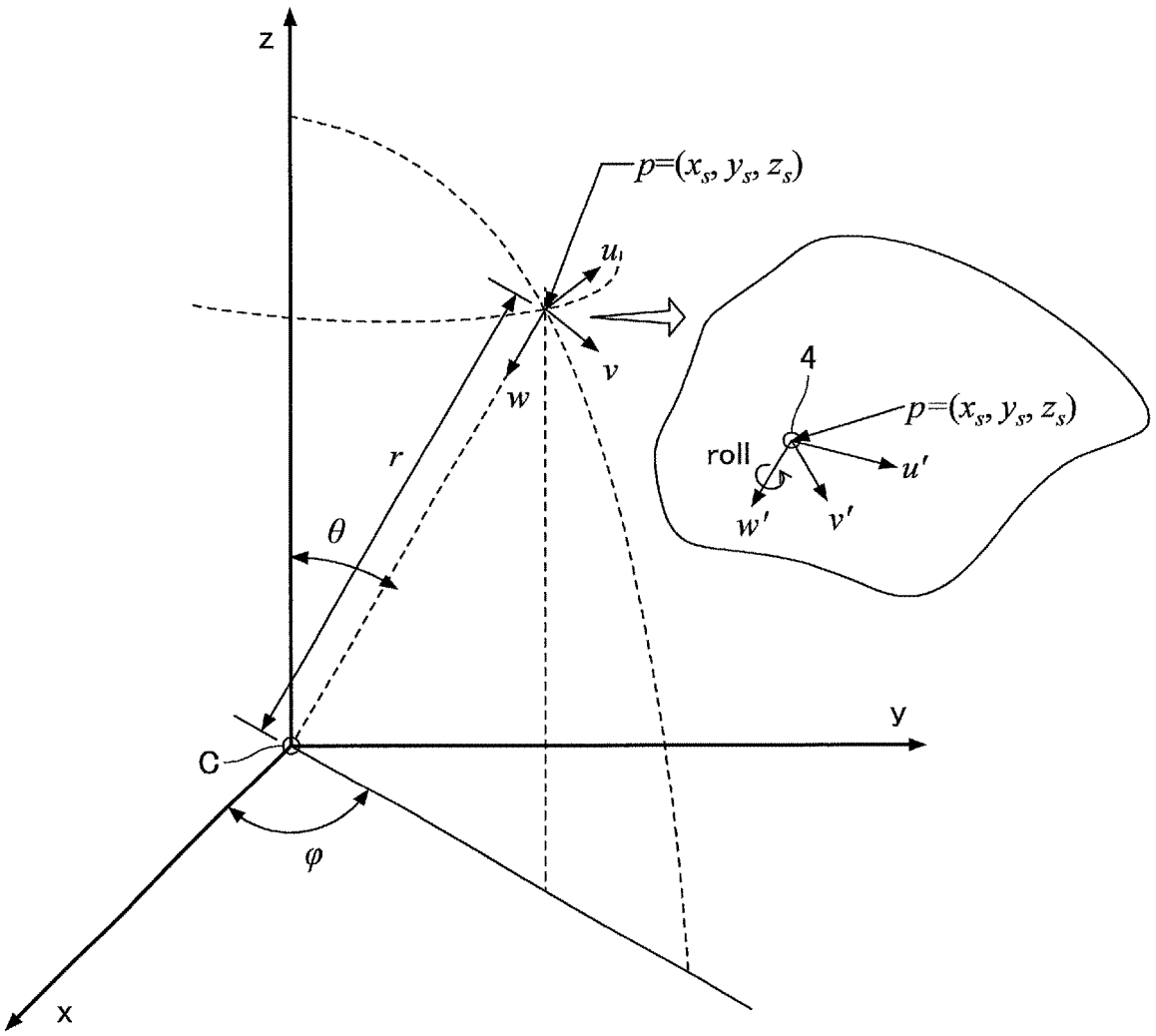
FIG. 18 is a diagram illustrating a new coordinate system for determining a position on which X-ray radiation is incident.

A new coordinate system is defined so that a line connecting the isocenter and the generation point of X-ray corresponds to z axis. FIG. 18 is a diagram illustrating the new coordinate system. In FIG. 18, the origin C of the xyz coordinate system corresponds to the isocenter. A point P of the xyz coordinate system corresponds to the X-ray generation point. A coordinate of the target (cancer affected part) in a further new coordinate system whose origin is the point P indicate a coordinate of the a irradiation target for the swing collimator. Therefore, the position of the target in the new coordinate system (uvw coordinate system) illustrated in FIG. 18 is calculated. The new coordinates system is obtained through coordinate conversion using formula (11).

[math. 8]

$$R_x(x) = \begin{bmatrix}1 & 0 & 0\\ 0 & \cos x & \sin x\\ 0 & -\sin x & \cos x\end{bmatrix} \tag{11}$$

$$R_y(x) = \begin{bmatrix}\cos x & 0 & -\sin x\\ 0 & 1 & 0\\ \sin x & 0 & \cos x\end{bmatrix}$$

$$R_z(x) = \begin{bmatrix}\cos x & \sin x & 0\\ -\sin x & \cos x & 0\\ 0 & 0 & 1\end{bmatrix}$$

The position of the target in the new coordinate system (xyz coordinate system) is obtained by using circular matrixes Rx(−θ)Rz(−π/2+φ). Moreover, the position of the target in the coordinate system (uvw coordinate system) whose origin is the X-ray generation point illustrated in FIG. 18 is obtained by using a rotation matrix Ry (π) and parallel movement "r".

[math. 9]

$$R\begin{bmatrix}u\\ v\\ w\end{bmatrix} = R_y(\pi)R_x(-\theta)R_z\left(-\frac{\pi}{2}+\varphi\right)\begin{bmatrix}\bar{x}\\ \bar{y}\\ \bar{z}\end{bmatrix} + \begin{bmatrix}0\\ 0\\ r\end{bmatrix} = \begin{bmatrix}\bar{y}\cos\varphi - \bar{x}\sin\varphi\\ -\bar{z}\sin\theta + \cos\theta(\bar{x}\cos\varphi + \bar{y}\sin\varphi)\\ r - \bar{z}\cos\theta - \bar{x}\sin\theta\cos\varphi - \bar{y}\sin\theta\sin\varphi\end{bmatrix} \tag{12}$$

In FIG. 18, in a case where the X-ray head 100 rotates about beam axis (w-axis) of emitted X-ray by rotation angle θroll, the position of the target defined in u'v'w' coordinate system is calculated by coordinate conversion Rz (x) shown in formula (11), where the u'v'w' coordinate system is generated by rotating the uvw coordinate system about the w-axis. Hence, a swing angle (θu, θv) of the swing collimator is calculated by formula (13) and formula (14) shown below.

Additionally, the rotation angle θroll is defined based on a coordinate (x, y, z, yaw, roll, pitch) of the X-ray head 100.

[math. 10]

$$\begin{bmatrix}u'\\ v'\\ w'\end{bmatrix} = \begin{bmatrix}\cos\theta_{roll} & \sin\theta_{roll} & 0\\ -\sin\theta_{roll} & \cos\theta_{roll} & 0\\ 0 & 0 & 1\end{bmatrix}\begin{bmatrix}u\\ v\\ w\end{bmatrix} \tag{13}$$

$$\theta_u = \arctan\left(\frac{u'}{\sqrt{v'^2 + w'^2}}\right) \tag{14}$$

$$\theta_v = \arctan\left(\frac{v'}{\sqrt{v'^2 + w'^2}}\right)$$

The swing angle (θu, θv) of the swing collimator corresponds to the swing angle (θx, θy) in the X-axis direction and the y-axis direction illustrated in FIG. 6 and FIG. 7. In this way, the swing angle (θx, θy) of the secondary collimator 20 can be calculated, and the tracking controller 71 provides the calculated (θx, θy) with the sub-unit controller 80. The in-X-ray head controller 90 receives the calculated (θx, θy) from the sub-unit controller 80 to perform swing control of the secondary collimator 20, thereby performing desired swing operation.

<X-Ray Radiation Apparatus>

Figure 11:
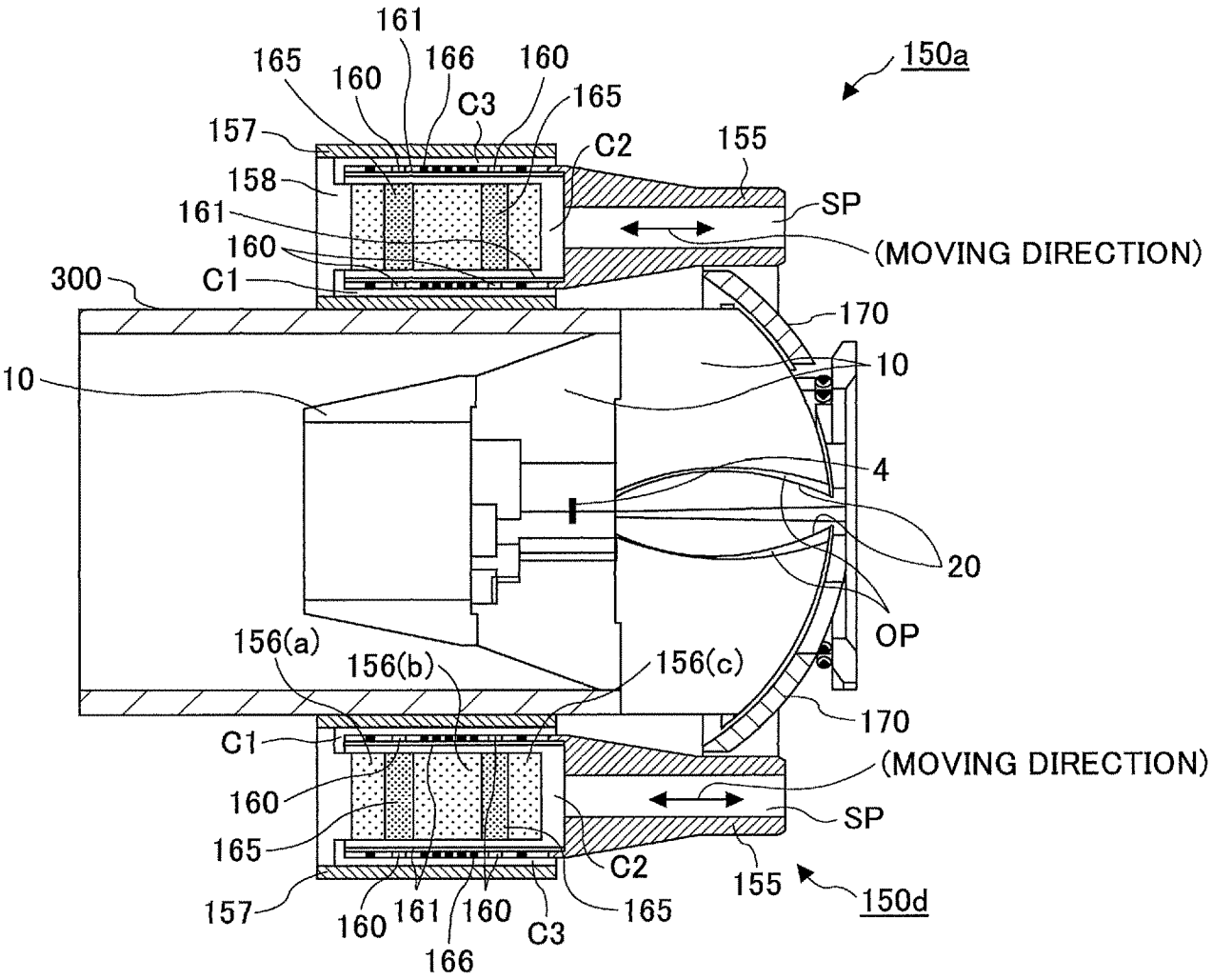
FIG. 11 is a cross sectional view in X-X illustrated in FIG. 8.

FIG. 8 to FIG. 11 are diagrams illustrating an example configuration of a X-ray radiation apparatus including the X-ray head 100. FIG. 8 is a front view of a X-ray radiation apparatus. FIG. 9 is perspective view of the X-ray radiation apparatus. FIG. 10 is a plane view of the X-ray radiation apparatus. FIG. 11 is a cross sectional view in X-X illustrated in FIG. 8. The X-ray radiation apparatus includes the X-ray head 100 described with reference to FIG. 2, FIG. 3, etc., in a X-ray head base 300. The X-ray head base 300 is formed as an approximately hollowed cylinder, where the first collimator (primary collimator 10) is disposed at one (X-ray emission side) end of the cylinder such that the end is closed with the first collimator. The target 4 that converts the electron beam emitted from electron gun 2 (see FIG. 3) into X-ray is disposed on a central axis of the first collimator (primary collimator 10), where a reference X-ray axis coincide with the central axis of the first collimator (primary collimator 10).

Four voice coil motors 150*a*, 150*b*, 150*c*, and 150*d*, which control the swing operation of the second collimator (secondary collimator 20) at least in two orthogonal directions, are disposed on an outer surface of X-ray head base 300, where the respective voice coil motors are disposed at quarter circumference intervals (disposed separately from one another by central angle 90° of a circle corresponding to the outer surface of the X-ray head base 300). The voice coil motors 150*a* to 150*d* are examples of the swing mechanism 25 illustrated in FIG. 2. The detection unit 31 (see FIG. 2) of the swing angle detection unit 30A is fixed and coupled to a front end of a bracket 180 extending from the outer surface of the X-ray head base 300. The planar reflection mirror 35 illustrated in FIG. 4 is fastened to an outer surface of a swing base 170 (movable member MV illustrated in FIG. 2), where the outer surface of a swing base 170 faces the detection unit 31.

The aiming laser unit 5 is disposed at a front end (X-ray emission side) of the voice coil motor 150*a* via a member if needed. The visible-light laser beam emitted from the aiming laser unit 5 overlaps with the X-ray axis through the optical system formed by mirror 7, and the like. Hence, a point on which the X-ray is incident can be seen with the visible-light laser beam. Further, the ion chamber 27 is fixed on an outside face of the swing base 170 positioned between the mirror 7 and the second collimator (secondary collimator 20) via a member if needed. Therefore, radiation dose, radiation direction, etc., can be easily measured.

In FIG. 9, the arc-like curved motion bearings 151*a* and 151*b* are disposed between the swing base 170 coupled to the second collimator (secondary collimator 20) and an intermediate member 152. Also, the arc-like curved motion bearings 151*c* and 151*d* are disposed between a mounting base 153 placed on the first collimator (primary collimator 10) and the intermediate member 152, where directions of the arc-like curved motion bearings 151*c* and 151*d* are orthogonal to the those of the arc-like curved motion bearings 151*a* and 151*b* (however, the arc-like curved motion bearing 151*d* is not depicted in FIG. 9). According to the configuration described above, the swing base 170 can perform a smooth swing operation.

<Swing Mechanism>

Figure 12:
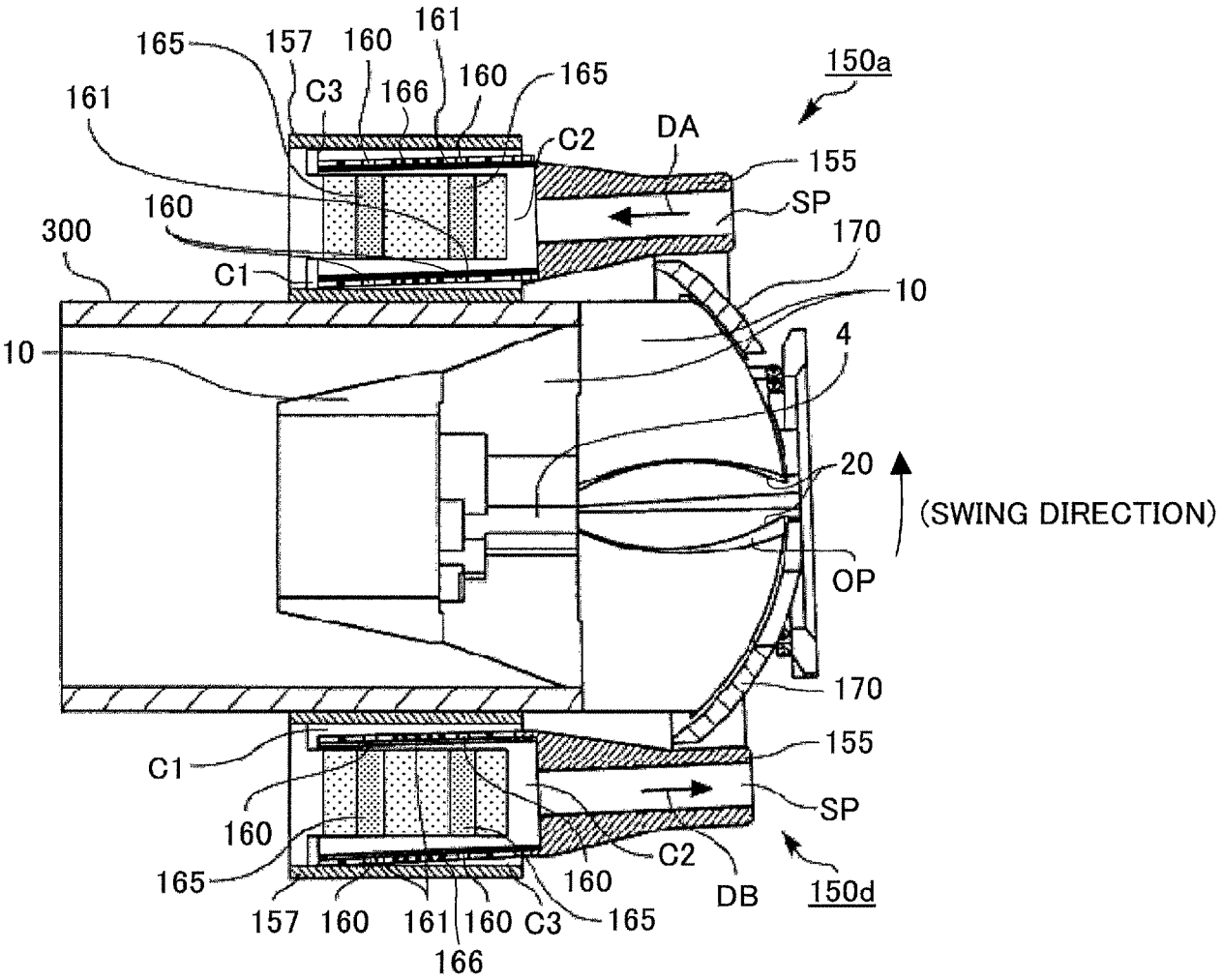
FIG. 12 is a cross sectional view illustrating swing operation of a second collimator in upside direction.
Figure 13:
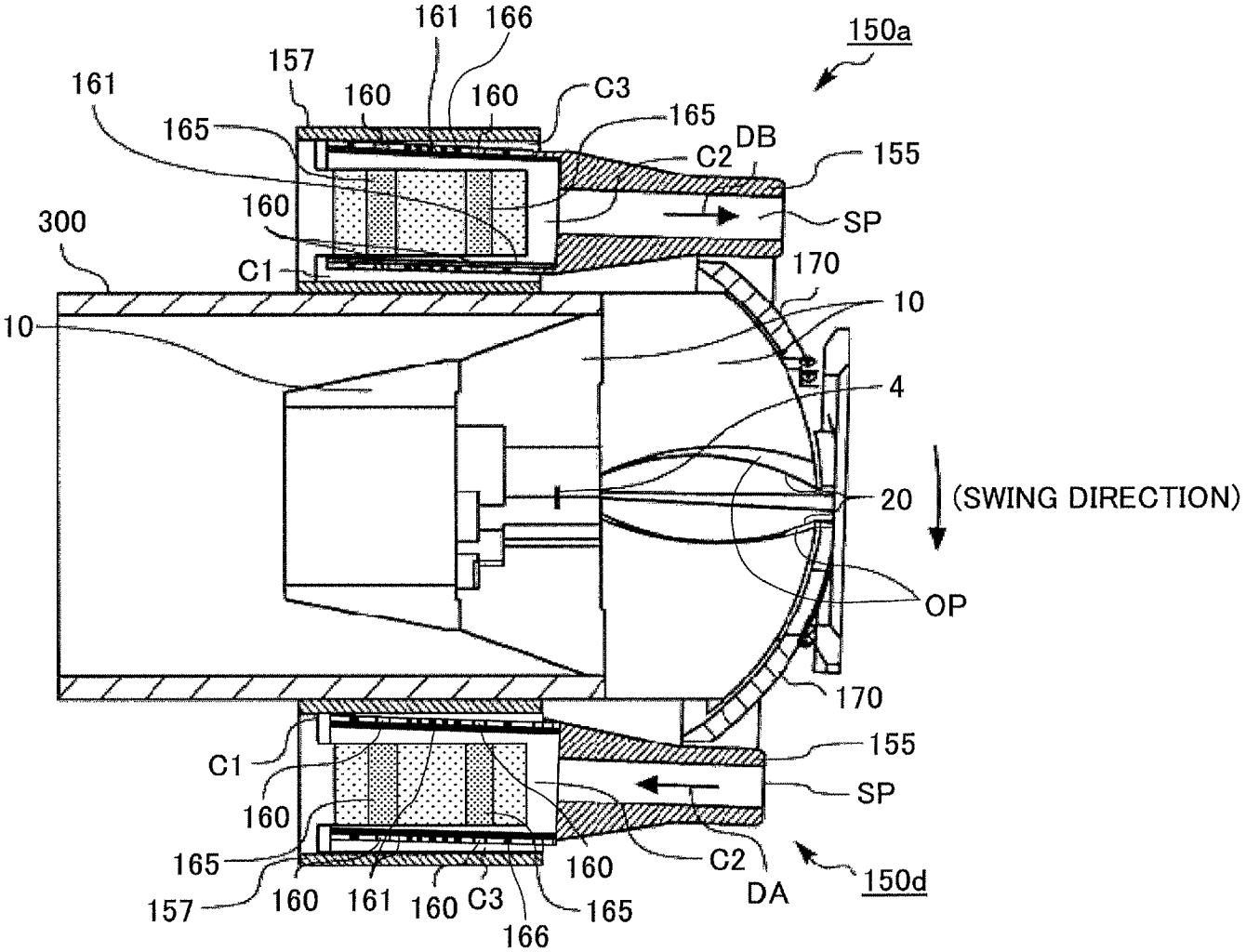
FIG. 13 is a cross sectional view illustrating the swing operation of the second collimator in downside direction.

In the following, the swing mechanism will be described with reference to FIG. 11 to FIG. 13. FIG. 11 to FIG. 13 are respectively cross sectional views in X-X of FIG. 8. Additionally, in FIG. 11 to FIG. 13, for better understanding, the collimators 10 and 20, etc., are not hatched, and the electron gun 2, the acceleration tube 3, etc., are omitted. In FIG. 11, the two voice coil motors 150*a* and 150*d* are schematically illustrated, where the respective voice coil motors 150*a*-150*b* have an identical configuration. A coil support pillar 155 extends in front side of the voice coli motor 150, and a bobbin 161 is coupled to rear end side of the voice coli motor 150, where a hollow portion SP is provided inside the coil support pillar 155. A conductive wire is wound around the bobbin 161 to form a coil. Two circular-shaped coil spacers 160 are disposed at an outer surface of the bobbin 161 at a certain interval. The conductive wire (depicted as black circles) is wound around the bobbin 161 at a portion between the coil spacers 160 and at portions left and right of the respective coil spacers 160, and consequently three coils are formed. Additionally, a winding direction of a mid coil is opposite to that of two outer coils 166.

A magnetic circuit of the voice coil motor 150 is fixed outside of the X-ray head base 300. Two circular magnets 165 for generating magnetic field are disposed inside the bobbin 161 as the magnet circuit. A circular inner yokes are formed at a portion between the magnets 165 and at portions left and right of the respective magnets 165. A cylindrical outer yoke 157 is formed outside the bobbin 161. Additionally, a first circular portion of the magnet 165 has one magnetic polarity while a second circular portion thereof has the other magnetic polarity. Here, the first circular portion of the magnet 165 is in contact with left inner yoke while the second circular portion thereof is in contact with the right inner yoke. A magnetic polarity of the second circular portion of a first magnet 165 is the same as the magnetic polarity of the first circular portion of a second magnet 165 (when one is "S", the other is also "S"), where one circular inner yoke is disposed between the first magnet and the second magnet. In this way, magnetic fluxes pass through hollow portions between an inner yokes and the outer yoke 157, where the magnetic fluxes interlink with respect to coils disposed at the hollow portions. Hence, "force" is generated when current flows in the coil. The outer yoke 157 and an inner yoke 156 (*a*) are coupled at a bottom of the voice coil motor via a base member 158 made of magnetic body. Additionally, C1, C2, and C3 illustrated in FIG. 11 to FIG. 13 indicate gaps in the voice coil motor 150. Further, the swing base 170 is disposed at front end of the first collimator (primary collimator 10) and the second collimator (secondary collimator 20), where a shape of the swing base 170 in front view resembles to a shape of steering wheel of a vehicle. The swing base 170 is coupled to the coil support pillar 155, while a center portion thereof is coupled to the second collimator (secondary collimator 20) via a member if needed.

According to the above described configuration, when current flows in a certain direction (herein after also referred to as "positive direction"), the coil support pillar 155 moves in right direction in FIGs due to magnetic field generated by a magnet 165 in accordance with the Fleming's left-hand rule. When current flows in a direction opposite to the certain direction (herein after also referred to as "negative direction"), the coil support pillar 155 moves in left direction in FIGs. The coil support pillar 155 moves in left-right direction in FIGs due to the current flowing in positive/negative direction through the voice coil motors 150*a* and

150*d* that face each other. The swing base 170 moves in up-down direction in FIGs. Consequently, the swing operation of the second collimator (secondary collimator 20) is performed. Additionally, the swing base 170 is coupled to a bearing (not shown) (coupling member including arc-like curved motion bearings in two directions so as to enable free movement in two directions in FIG. 9) disposed on the spherical surface of the first collimator (primary collimator 10), and this configuration enables the swing operation.

FIG. 12 is a diagram illustrating swing operation of the second collimator (secondary collimator 20) in upside direction of FIG. 12. When currents respectively flow through the voice coil motor 150*a* and the voice coil motor 150*d* in negative direction and positive direction, respective coil support pillars 155 move leftward in FIG. 12 (direction of arrow DA) and rightward in FIG. 12 (direction of arrow DB). Consequently, the swing base 170 moves upward to cause the second collimator (secondary collimator 20) to move upward.

FIG. 13 is a diagram illustrating the swing operation of the second collimator (secondary collimator 20) in downside direction of FIG. 13. When currents respectively flow through the voice coil motor 150*a* and the voice coil motor 150*d* in positive direction and negative direction, respective coil support pillars 155 move rightward in FIG. 13 (direction of arrow DB) and leftward in FIG. 13 (direction of arrow DA). Consequently, the swing base 170 moves downward to cause the second collimator (secondary collimator 20) to move downward. As described above, the swing operation of the second collimator (secondary collimator 20) in up-down direction of FIG. 12 and FIG. 13 can be achieved.

Figure 14A:
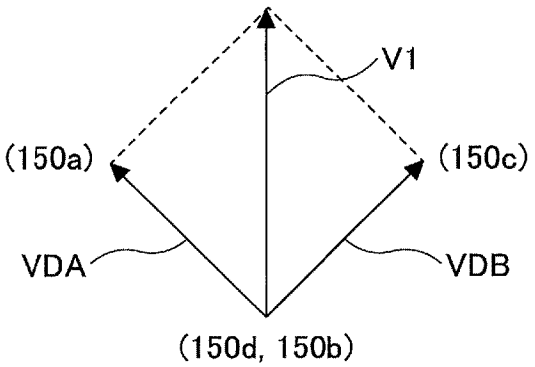
FIG. 14A is a diagram illustrating the swing operation.
Figure 14B:
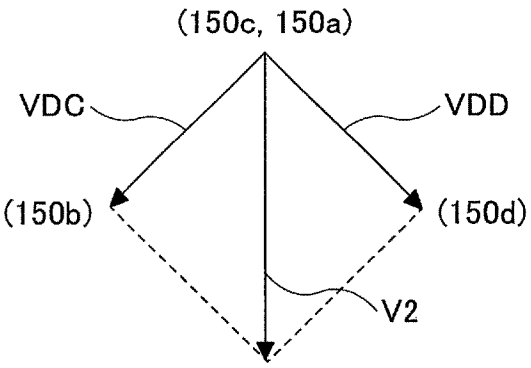
FIG. 14B is another diagram illustrating the swing operation.

FIG. 14A to FIG. 14D are diagrams schematically illustrating the swing operation of the second collimator (secondary collimator 20) by using four voice coil motors 150*a*, 150*b*, 150*c*, and 150*d*. The swing operations described with reference to FIG. 12 and FIG. 13 correspond to FIG. 14A and FIG. 14B, where directions can be understand by referring FIG. 8 with FIG. 14A-FIG. 140. As illustrated in FIG. 14A, resultant force V1 of a force VDA (depicted as a vector) and VDB is directed upward, where the force VDA is applied to move the swing base 170 by the voice coil motors 150*a* and 150*d*, and the force VDB is applied to move the swing base 170 by the voice coil motors 150*b* and 150*c*. On the other hand, when directions of the current flowing in the four motors are reversed, resultant force V2 of a force VDD (depicted as a vector) and VDC is directed downward, where the force VDD is applied to move the swing base 170 by the voice coil motors 150*a* and 150*d*, and the force VDC is applied to move the swing base 170 by the voice coil motors 150*b* and 150*c*. Consequently, as illustrated in FIG. 14A and FIG. 14B, the second collimator (secondary collimator 20) can be swung in up-down direction in accordance with motor drive operation. The swing amount can be adjusted by adjusting values of the currents supplied to the respective motors.

Figure 14C:
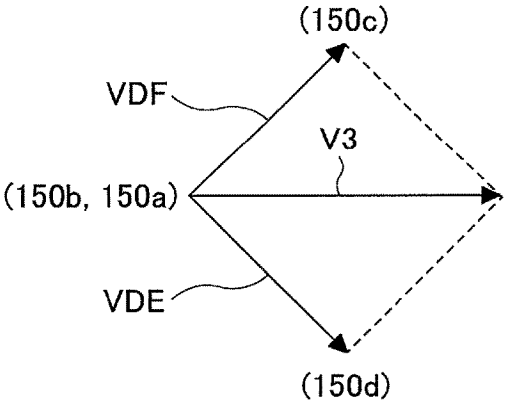
FIG. 14C is still another diagram illustrating the swing operation.
Figure 14D:
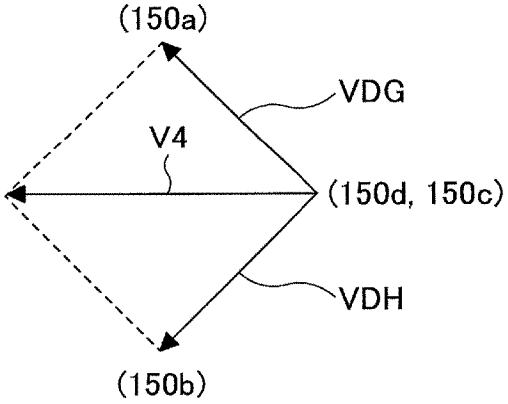
FIG. 14D is still another diagram illustrating the swing operation.

FIG. 14C illustrates a state of respective forces, where the currents flowing through voice coil motors 150*a* and 150*d* are reversed from a state illustrated in FIG. 14A. As illustrated in FIG. 14C, a resultant force V3 of a force VDF and VDE is directed rightward, where the force VDF is applied to move the swing base 170 by the voice coil motors 150*a* and 150*d*, and the force VDE is applied to move the swing base 170 by the voice coil motors 150*b* and 150*c*. On the other hand, FIG. 14D illustrates a state of respective forces, where the currents flowing through voice coil motors 150*b* and 150*c* are reversed from a state illustrated in FIG. 14A. As illustrated in FIG. 14D, resultant force V4 of a force VDG and VDH is directed leftward, where the force VDG is applied to move the swing base 170 by the voice coil motors 150*a* and 150*d*, and the force VDH is applied to move the swing base 170 by the voice coil motors 150*b* and 150*c*. Consequently, as illustrated in FIG. 14C and FIG. 14D, the second collimator (secondary collimator 20) can be swung in left-right direction in accordance with motor drive operation. The swing amount can be adjusted by adjusting values of the currents supplied to the respective motors. The above described motor control is performed by the in-X-ray head controller 90 that has received the swing angle setting information (θx, θy). In another embodiment, the voice coil motor may be formed by one coil and one magnet. In this case, the base member 158 for coupling the outer yoke 157 illustrated in FIG. 11 and the inner yoke 156(*a*) is also made of yoke member, where one coil is formed on the bobbin at a position where the coil interlinks with a magnetic path passing through a space between the inner yoke 156(*c*) disposed in open end side of the voice coil motor and the outer yoke 157 (this configuration is achieved by removing the inner yoke 156(*b*) from the configuration illustrated in FIG. 11). Additionally, in the voice coil motor, a movable portion is allowed to be tilted (see FIG. 12 and FIG. 13). Therefore, a link mechanism is not required in a case where the configuration of the present embodiment is adopted. Hence, problems related to fluctuation can be solved and stable operations can be performed. Therefore, if a linear motor such as a piezo actuator is adopted in the swing mechanism, a link mechanism with a high precision may be combined with the swing mechanism.

<Dimension, Appearance of Apparatus, Etc.>

As described above, the second collimator (secondary collimator 20) can swing in 360° direction by "3 (deg)" when the flow direction and value of the current flowing through respective voice coil motors 150*a*-150*d* are appropriately adjusted. Also, size of the apparatus illustrated in FIG. 8, FIG. 9 and FIG. 10 is 250 mm at maximum in longitudinal direction, 250 mm at maximum in lateral direction, and 200 mm at maximum in depth direction, and weight thereof is 6 kg. A size reduction is achieved at this stage.

Figure 15:
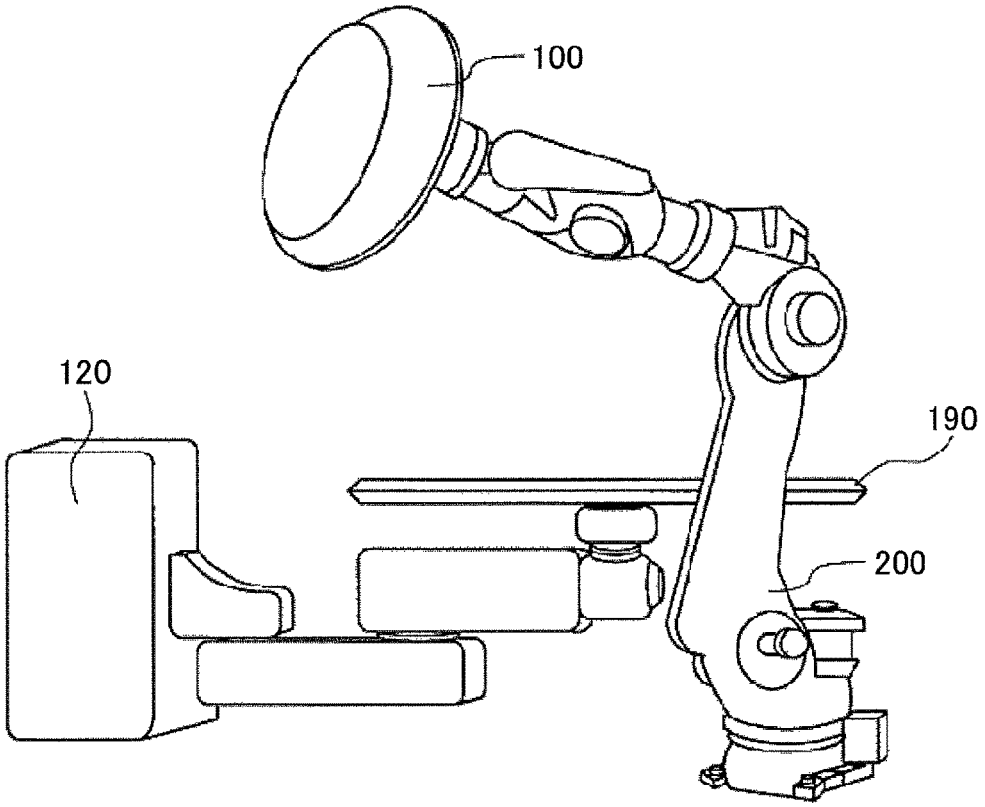
FIG. 15 is an external view of the radiation therapy system.

FIG. 15 is an external view of the radiation therapy system 1. In FIG. 15, although the combination of the X-ray tube 50*a* and the FDP 60*a* and the combination of the X-ray tube 50*b* and the FDP 60*b* are omitted, the arrangement of the X-ray tubes 50*a* and 50*b* and the FDPs 60*a* and 60*b* and the function thereof (as imager) are already described with reference to FIGS. 16 and 17 in <Image Processing>. The patient P lies on the couch 190 to take X-ray therapy. At this time, the six-axial manipulator 200 moves the X-ray head 100 up to a desired position. The control apparatus performs this control. As illustrated in FIG. 15, the apparatus including the X-ray head 100 whose appearance has been described with reference to FIG. 8 to FIG. 10 is attached to an arm, where the size and the weight thereof are appropriate for being attached to the arm of the six-axial manipulator 200. Additionally, preferably, a central axis of rotation in the swing operation of a swing unit approximately coincide with center of mass of the swing unit on the ground that the swing unit does not swing on its own, etc., where the swing unit are made of the second collimator (secondary collimator 20) and components (swing angle detection unit 30, etc.) attached thereto.

<Variation 1>

Figure 19:
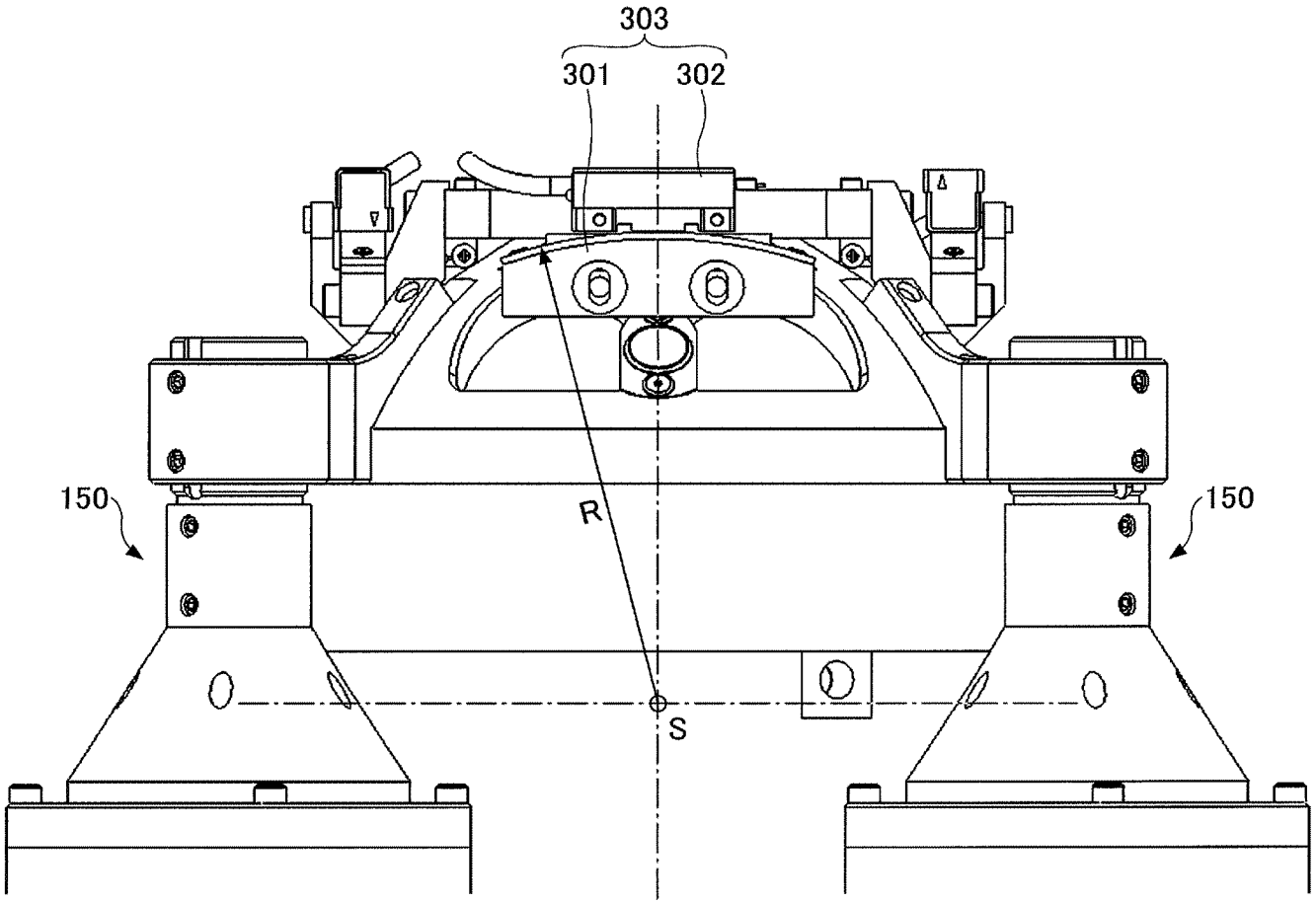
FIG. 19 is a front view of a liner encoder that is a part of a swing angle detector.
Figure 20:
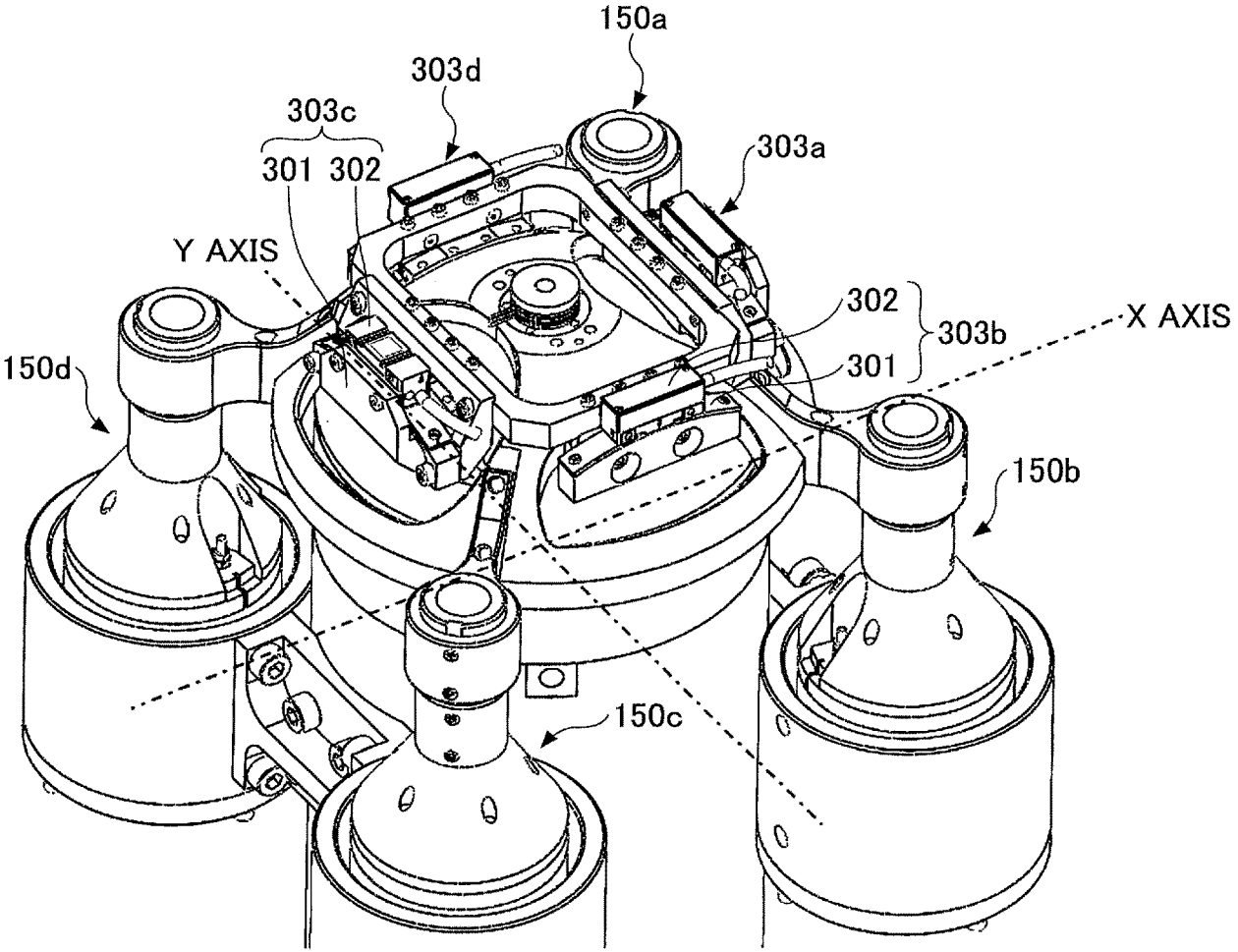
FIG. 20 is a perspective view of the liner encoder illustrating positional relation between voice coil motors and the liner encoder.

FIG. 19-FIG. 22 are diagrams illustrating a swing angle detector 30B as an example displacement amount detection unit. The swing angle detector 30B that is an encoder type detector may be used instead of the swing angle detector 30A that is a detector using an optical system illustrated in FIG. 4. FIG. 19 is a front view of a liner encoder 303 that is a part of the swing angle detector 30B. FIG. 20 is a perspective view of the liner encoder 303 illustrating positional relation between voice coil motors 150*a*-150*d* and the liner encoder 303. As illustrated in FIG. 20, the swing angle detector 30B includes at least a pair of liner encoders 303 arranged along the X-axis and the Y-axis, where the X-axis and the Y-axis indicate swing direction of the secondary collimator 20. In the example illustrated in FIG. 20, the swing angle detector 30B includes four liner encoders 303*a*-303*d* (collectively referred to as "liner encoders 303", if needed), where the liner encoders 303*b* and 303*d* are arranged along the X-axis, and liner encoders 303*a* and 303*c* are arranged along the Y-axis. One combination of liner encoders 303*a* and 303*b* and another combination of liner encoders 303*c* and 303*d* are provided. Although displacement amounts (swing angle) in the X-axis direction and the Y-axis direction with respect to a reference position can be detected by using any one of the combinations, a reliability of the apparatus can be improved when the two combinations are used.

Referring back to FIG. 19, the liner encoders 303 respectively include a liner scale 301 and an encoder sensor 302. The liner scale 301 includes a scaler surface formed in a shape of an arc with a center S and a radius R. The center S is a position defined by moving the target 4, that is, the origin of the swing operation and X-ray generation source in parallel with the X-axis or the Y-axis up to a position corresponding to surface of the liner scale 301. A sensor surface of the encoder sensor 302 faces the arc shaped scaler surface of the liner scale 301. The encoder sensor 302 performs arcuate movement due to the swing operation of the secondary collimator 20 caused by the voice coil motors 150*a*-150*d*, whereas the encoder sensor 302 is kept separate by a predetermined distance from the liner scale 301. Thus, the encoder sensor 302 is relatively moved with respect to the liner scale 301.

Figure 21:
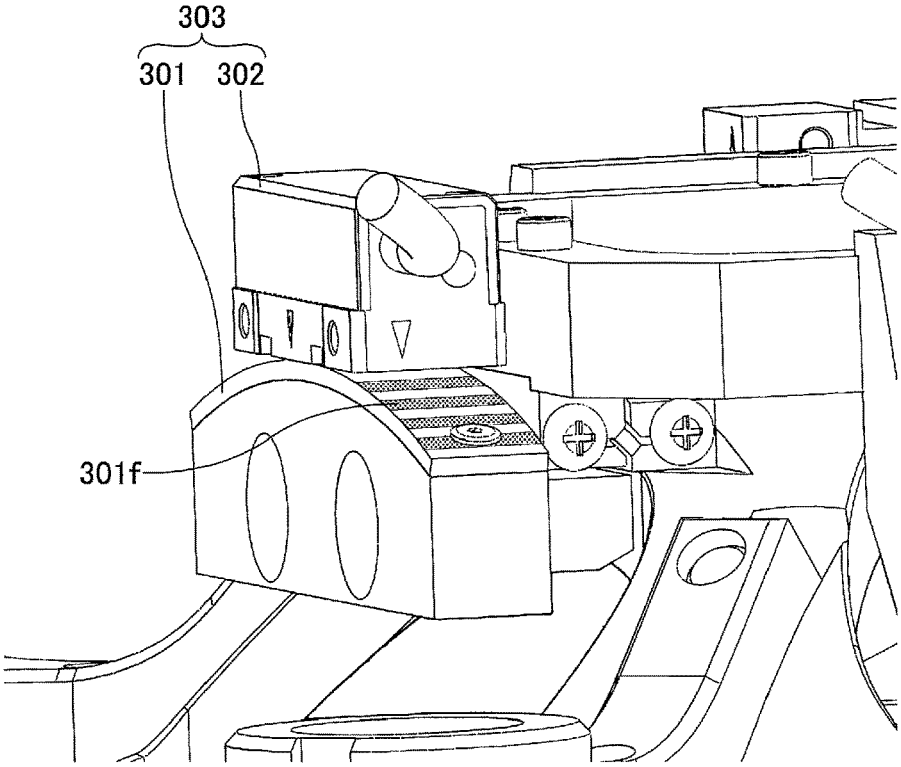
FIG. 21 is an enlarged view of the liner encoder.

FIG. 21 is an enlarged view of the liner encoder 303. Scales are formed on the arcuate scaler surface 301*f* of the liner scale 301 at predetermined intervals. The interval between the scales, that is, a unit distance is correlated with a resolution capability of the liner scale 301. The position information of the scaler surface 301*f* read by the encoder sensor 302 indicates the resolution capability and angle information that is determined by the curvature radius R.

Magnetic encoder or optical encoder may be used as the liner encoder 303. In a case of magnetic encoder, for example, S poles and N poles of micro magnets are alternately arranged on the scaler surface 301*f*, and the relative displacement amount is detected by a magnetic sensor of the encoder sensor 302. In a case of optical sensor, for example, reflecting faces and absorbing faces are alternately arranged on the scaler surface 301*f*, and the relative displacement amount is detected by an optical sensor of the encoder sensor 302. The magnetic encoder has a high environmental robustness against dust, oil, and the like. The optical encoder provided at low cost can be used in a good environmental condition.

Figure 22:
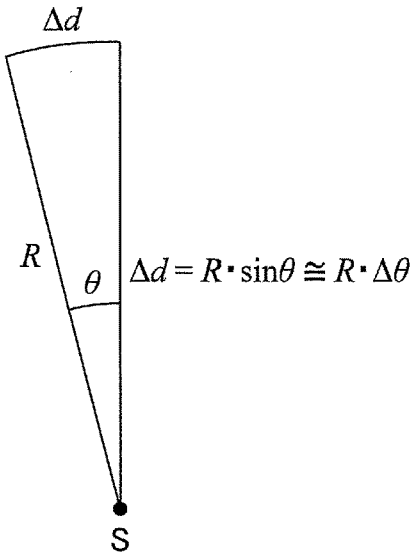
FIG. 22 is a diagram illustrating a detection operation of a swing angle based on information obtained through an encoder sensor.

FIG. 22 is a diagram illustrating a detection operation of the swing angle based on information obtained through the encoder sensor 302. The unit distance $\Delta d$ of the liner scale 301 can be converted into a unit angle by using the curvature radius R of the scaler surface 301*f*. In a case where "$\Delta d = R \times \sin\theta$" and "$\theta$" is small, approximate equation "$\sin\theta \approx \Delta\theta$" is true. A required resolution capability is appropriately determined in accordance with a size of the affected part and a spot diameter of radiation X-ray on the order of several nanometer (nm) to several hundred micron. When the position information obtained through the encoder sensor 302 is converted into the angle, the swing angle $\theta$ can be found.

Outputs from the liner encoders 303*b* and 303*d* that are arranged along the X-axis indicate the swing angle $\theta y$ about the Y-axis. Outputs from the liner encoders 303*a* and 303*c* that are arranged along the Y-axis indicate the swing angle $\theta x$ about the X-axis. When two combinations of the liner encoders are used for detecting the swing angle ($\theta x$, $\theta y$), an abnormality of the sensor itself can be detected, and buck-up in case of sensor failure can be achieved. Additionally, the swing angle ($\theta x$, $\theta y$) detected by the swing angle detector 30B using the liner encoder 303 corresponds to ($\theta' x$, $\theta' y$) used in feedback control illustrated in FIG. 6.

The same types of liner encoders 303 may be used for both two combinations of liner encoders, or magnetic liner encoders may be used for the one combination while optical liner encoders are used for the other combination. Also, one combination of the liner encoders 303 may be used in conjunction with the swing angle detector 30A illustrated in FIG. 4.

Output types of the liner encoder 303 can be divided into an incremental type and an absolute type. In a case of the incremental type, an origin determination operation is required at every power off-on operation. In a case of the absolute type, the operation is not required because position information has recorded. Both output types are available.

As for positional relationship between the voice coil motors 150*a*-150*d* and the liner encoders 303*a*-303*d*, the linear encoders 303 may be inclined by 45° with respect to diagonal lines that connect voice coli motors 150 respectively facing each other as illustrated in FIG. 20. In this case, the X-axis and the Y-axis that are references for swing direction incline by 45° with respect to diagonal lines of voice coil motors 150*a*-150*d*, and the liner encoders 303*a*-303*d* are arranged in parallel with the X-axis or the Y-axis. This arrangement is preferable for reducing the size of apparatus.

Also, the liner encoders 303*a*-303*d* may be arranged in parallel with diagonal lines of voice coil motors 150*a*-150*d*. In this case, driving axes of voice coil motors 150*a*-150*d* coincide with the X-axis or the Y-axis that are references for swing direction, and the position to angle conversion of the liner encoder 303 can be simplified. Therefore, control operations with higher precision are expected.

<Variation 2>

Figure 23:
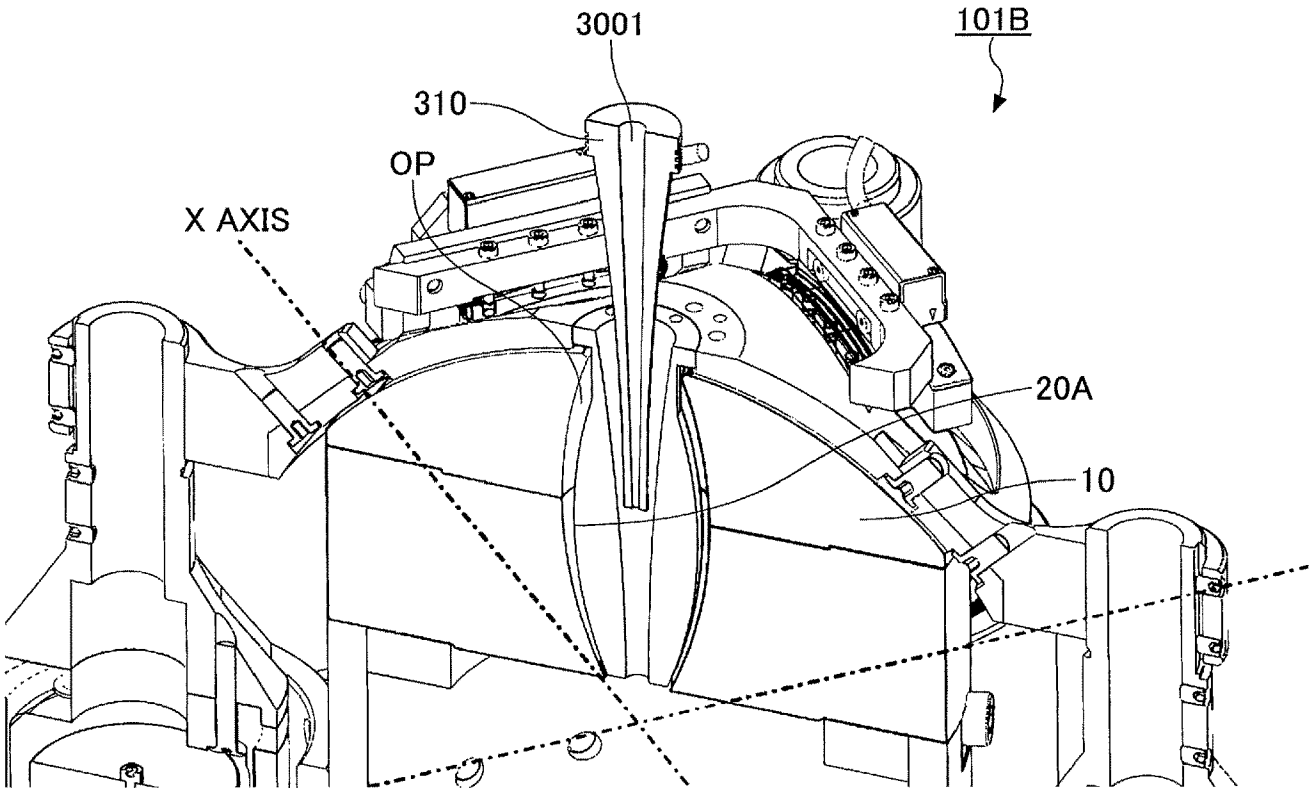
FIG. 23 is a diagram illustrating an example configuration when using a third collimator.
Figure 24A:
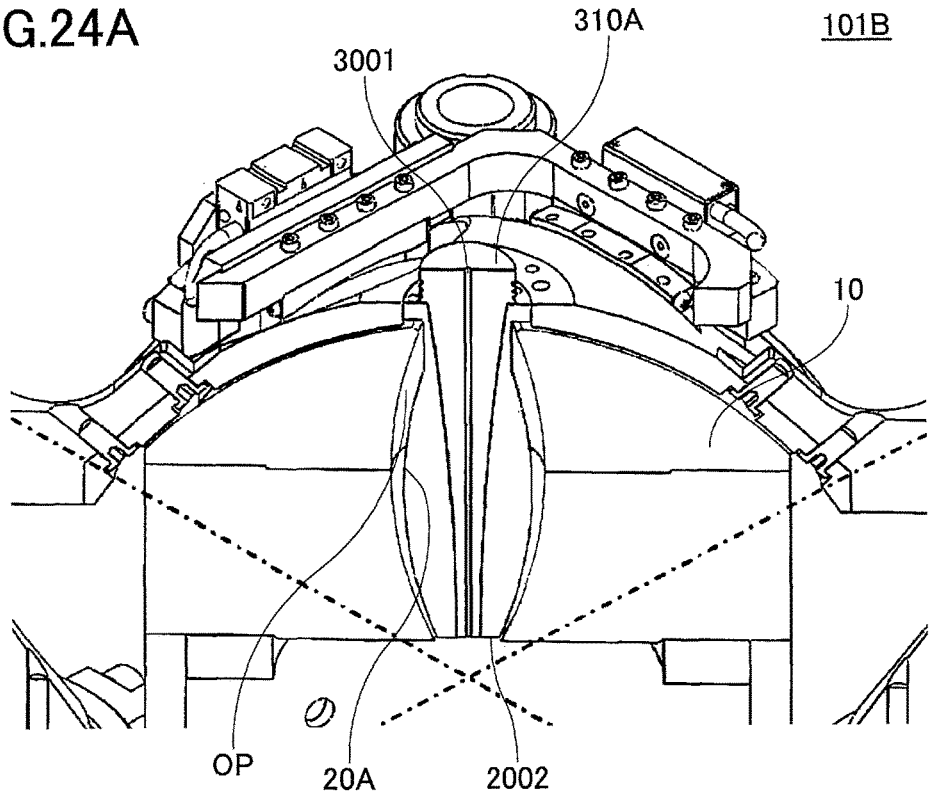
FIG. 24A is a diagram illustrating the second collimator and the third collimator inserted in the second collimator.
Figure 24B:
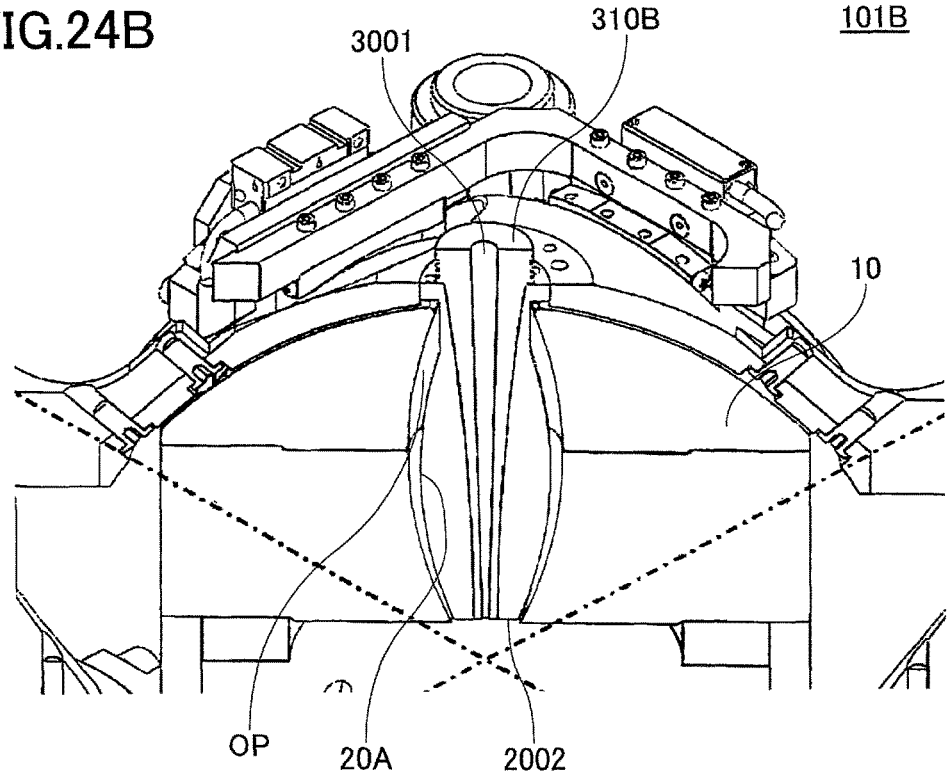
FIG. 24B is another diagram illustrating the second collimator and the third collimator inserted in the second collimator.

FIG. 23 and FIGS. 24A and 24B illustrates an example variation embodiment of the collimator, in which a collimator apparatus 101B using a third collimator 310 is disclosed. This variation embodiment illustrated in FIG. 23 and FIGS. 24A and 243 is similar to FIG. 2 in that a gap OP is provided inside the first collimator (primary collimator) 10 so as to enable the swing operation of the second collimator (secondary collimator) 20A. In FIG. 23, a third collimator 310 is disposed in the second collimator 20A in a manner such that the third collimator 310 is exchangeable so as to change the irradiation field. A beam spot diameter of radiation X-ray may be preferably narrowed in accordance with the position or size of the affected part. Also, the beam spot diameter of radiation X-ray is preferably able to be selected or changed according to a position, size, etc., of the affected part. The third collimator 310 enables such an adjustment of the irradiation field.

A shape of the second collimator 20A of the variation embodiment illustrated in FIG. 23 and FIG. 24 is different from that of the secondary collimator 20 illustrated in FIG. 2 since the third collimator 310 needs to be included therein. The swing operation using the gap OP between the inner wall of the first collimator 10 and the external surface of second collimator is a common function to both the secondary collimator 20 and the second collimator 20A. Functions for causing X-ray to pass along the axis of the second collimator 20A, for forming the irradiation field, and for reducing leaked dose using an external shape of the second collimator 20A and a shape of the first collimator 10 are achieved by the second collimator 20A and the third collimator integrated therein. In particular, the formation of the irradiation field is achieved by the third collimator.

The second collimator 20A has a shape with which the third collimator 310 is accommodated and the swing operation can be performed inside the first collimator 10. For example, an external wall of the second collimator 210 is formed in a shape of gentle curvature so as to allow the swing operation using the gap OP and to stably achieve the shielding of X-ray. FIG. 24A and FIG. 24B are diagrams illustrating an example arrangements of the third collimator 310. External shapes of the third collimator 310A illustrated in FIG. 24A and the third collimator 310B illustrated in FIG. 24B are the same. However, diameters of respective collimate spaces 3001 are different from each other. The collimate space 3001 in FIG. 24A is smaller than the collimate space 3001 in FIG. 24B, and the X-ray radiation beam can be more narrowed with the collimate space 3001 in FIG. 24A. A desired beam diameter can be obtained by inserting the third collimator 310A or the third collimator 310B in the second collimator 20A, where the third collimator is exchangeable.

The third collimators 310A and 310B are pushed into the second collimator 20A up to an output end 2002. The second collimator 20A swings with the third collimators 310A and 310B integrated therein. The swing operation inside the first collimator 10 is performed by the second collimator 20A. The third collimator 310 is fixed in the second collimator 20A, and consequently performs the swing operation with the second collimator 20A. According to the configuration described above, the irradiation field can be easily changed without disturbing the swing operation of the second collimator 20A.

Additionally, a plurality of second collimators having discrete diameters may be provided instead of the third collimators, where the second collimators are exchangeable.

<Hardware Configuration of Control System and Process Flow>

Figure 25:
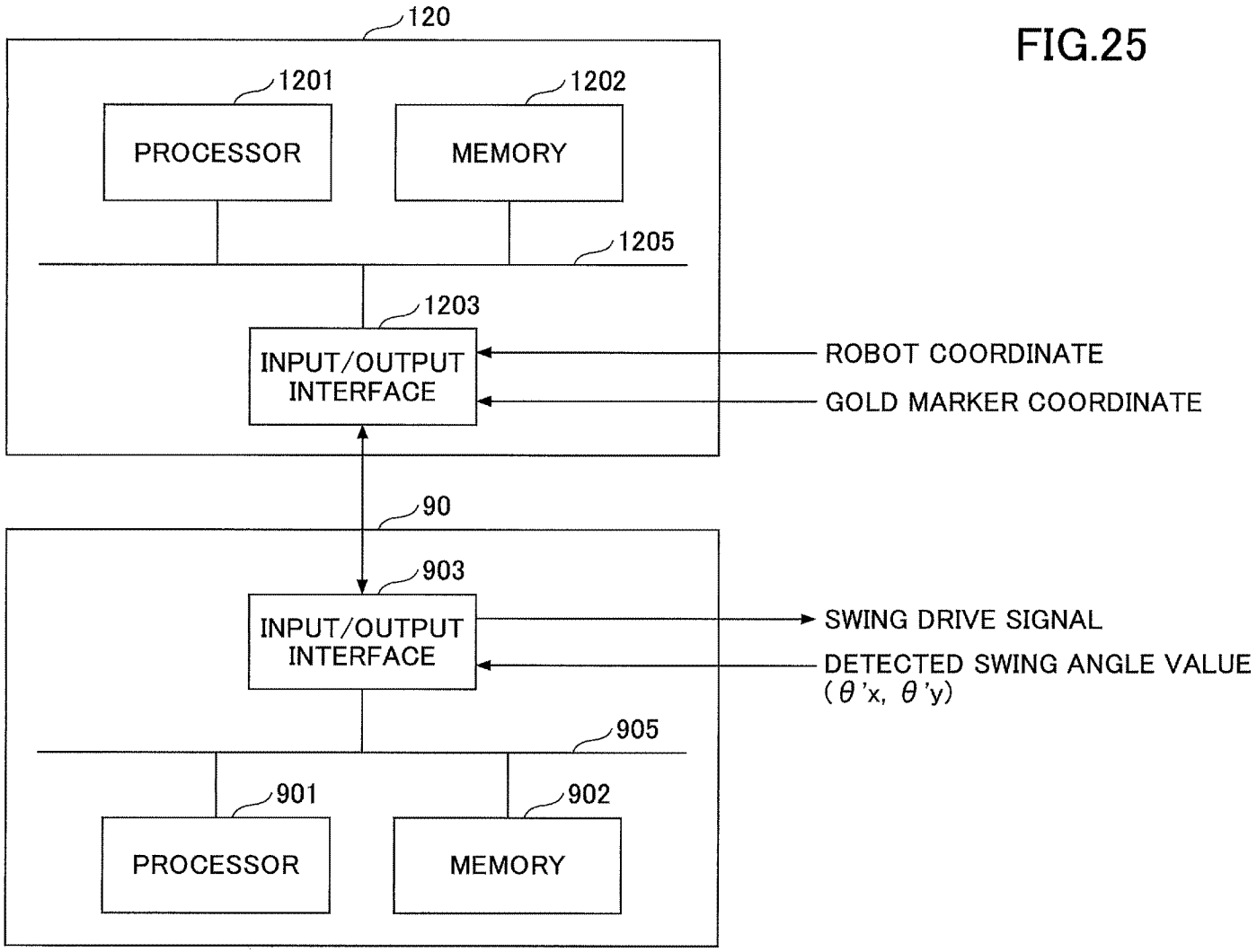
FIG. 25 is a diagram illustrating a hardware configuration of a control system for controlling the swing operation.

FIG. 25 is a diagram illustrating a hardware configuration of a control system. The control apparatus 120 includes a processor 1201, a memory 1202, an input/output interface 1203, where the respective units are connected by a bus 1205. The in-X-ray head controller 90 includes a processor 901, a memory 902, an input/output interface 903, where the respective units are connected by a bus 905. In FIG. 25, although the control apparatus 120 and the in-X-ray head controller 90 are depicted as discrete hardware components, the control apparatus 120 and the in-X-ray head controller 90 may be formed as a single hardware component by disposing a SoC (System on Chip) and a memory chip on a control board.

The processor 1201 of the control apparatus 120 controls entire operation of the control apparatus 120, and performs various calculations. The memory 1202 includes a ROM (read only memory) that stores a basic input/output program and a calculation programs and a RAM (random access memory) that is used as a work area for the processor 1201. The input/output interface 1203 includes a connection interface for external device, and may include a communication device operated in accordance with a predetermined protocol if needed. The input/output interface 1203 receives a robot coordinate, that is, a current coordinate (x, y, z, yaw, roll, pitch) of the X-ray head from the six-axial manipulator 200, and stores the coordinate in the memory 1202. Also, the input/output interface 1203 receives a coordinate of the gold marker or a coordinate of irradiation target (affected part) calculated based on the coordinate of the gold marker from the imager 65 (see FIG. 7), and stores the coordinate in the memory 1202. The processor 1201 retrieves the coordinate from the memory 1202 to calculate the swing angle of the second collimator 20 (or 20A), and transmits a swing angle instruction to the in-X-ray head controller 90 through the input/output interface 1203.

The processor 901 of the in-X-ray head controller 90 controls an entire operation of the in-X-ray head controller 90, and performs various calculations. The memory 902 includes a ROM (read only memory) that stores a basic input/output program and a calculation programs and a RAM (random access memory) that is used as a work area for the processor 901. The input/output interface 903 includes a connection interface for external device, and may include a communication device operated in accordance with a predetermined protocol if needed. The input/output interface 903 receives the swing angle instruction from the control apparatus 120 to store the swing angle instruction in the memory 902. The input/output interface 903 receives a detected current swing angle value of the second collimator 20 (or 20A) from the swing angle detector 30A or 30B to store the value in the memory 902. The processor 901 retrieves the swing angle instruction and the detected current swing angle value from the memory 902 to calculate the drive amount for swing operation, and outputs a swing drive signal for swing operation through the input/output interface 903.

In a case where the control apparatus 120 and the in-X-ray head controller 90 are integrated in one control board, the control board may be disposed in a main body of the six-axial manipulator 200, and the robot coordinate (position coordinate of X-ray head) may be directly obtained. Also, the control board and the swing mechanism 25 or the swing angle detector 30A (or 30B) may be connected by signal lines, where drive current or sensor output are transmitted/received through the signal lines.

Figure 26:
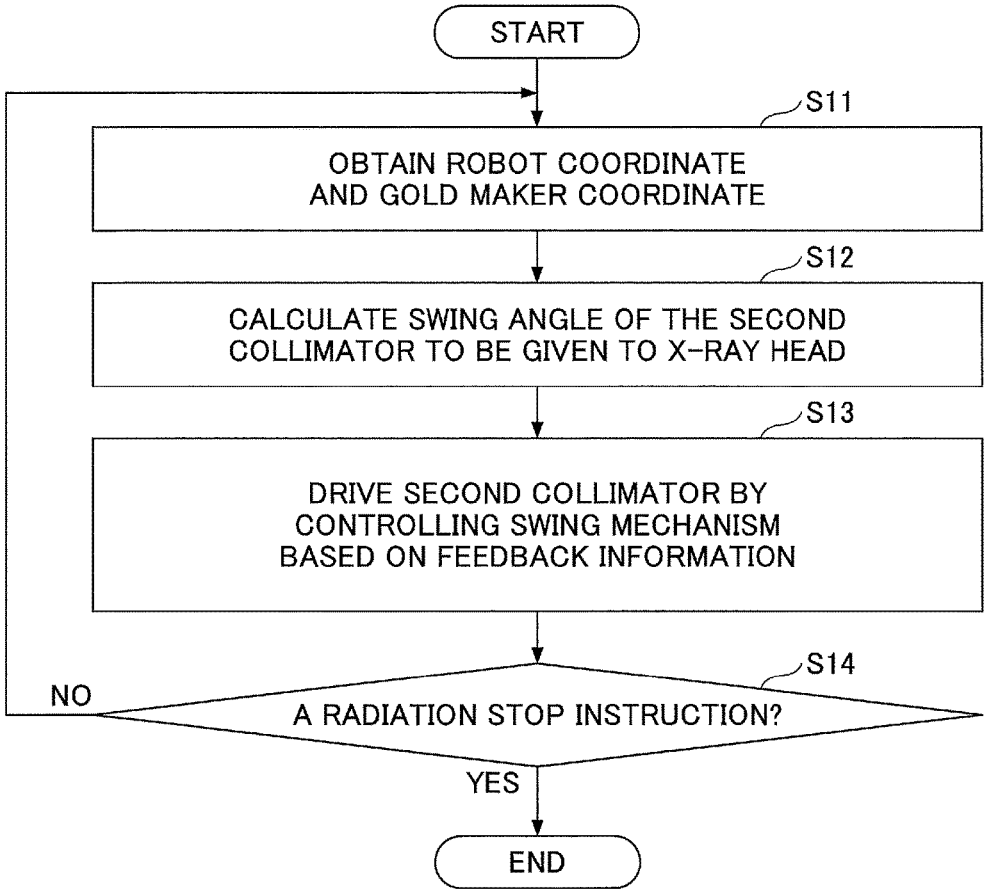
FIG. 26 is a flowchart illustrating a basic process flow of the swing operation of the collimator.

FIG. 26 is a flowchart illustrating a basic process flow of the radiation therapy system 1. First, the robot coordinate (x, y, z, yaw, roll, pitch) of the six-axial manipulator 200 and the coordinate (x, y, z) of the gold marker are obtained (S11). The coordinate (x, y, z) of the affected part calculated by the imager 65 may be obtained instead of the coordinate of the gold marker. In the latter case, the coordinate of the affected part may not be calculated by the control apparatus 120.

The swing angle (θx, θy) of the second collimator 20 (or 20A) is calculated based on the obtained information to be given to the X-ray head 100 as the swing angle instruction (S12). The calculation method of the swing angle has been described with reference to FIG. 18.

The second collimator is driven inside the first collimator by controlling the swing mechanism 25 based on the given swing angle and feedback information of the detected swing angle (S13). Processes of steps S11-S13 are repeatedly performed until a radiation stop instruction is given (S14).

The process of FIG. 26 may be performed by executing the program stored in the memory 1202 and/or memory 902 by the processor 1201 or the processor 901. In a case where a single control board is used, a processor on the control board may execute a program stored in a recording medium such as a ROM.

Figure 27:
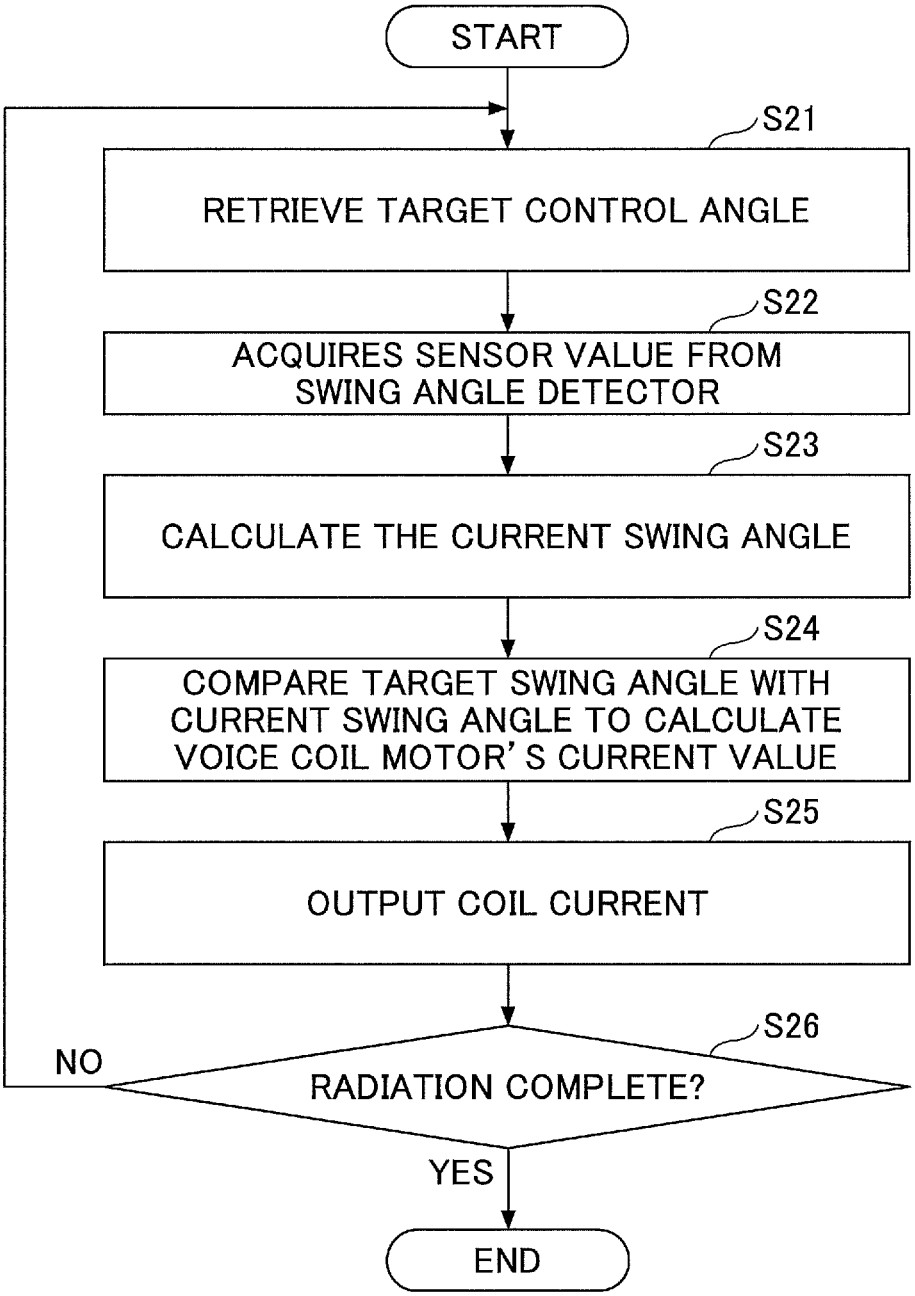
FIG. 27 is a flowchart illustrating a specific example of a process performed in step S13 in FIG. 26.

FIG. 27 is a flowchart illustrating a specific example of a process performed in step S13 in FIG. 26. For example, the in-X-ray head controller 90 retrieves a target control angle (θx, θy) from the memory 902 (S21). The target control angle (θx, θy) may be given from the control apparatus 120, and stored in the memory 902. Also, target control angle (θx, θy) may be calculated by the processor on the control board in a case where the control apparatus 120 and the in-X-ray head controller 90 are integrated in a control board.

The in-X-ray head controller 90 acquires the sensor value from the swing angle detector 30A or 30B (S22) to calculate the current swing angle (θ'x, θ'y) (S23). A sequence to perform steps S21, S22, and S23 may be changed and the steps S21, S22, and S23 may be performed simultaneously. Also, the current swing angle (θ'x, θ'y) may be calculated by the swing angle detector 30A or 30B, and the calculated swing angle may be input to the in-X-ray head controller 90.

The in-X-ray head controller 90 compares the target swing angle with the current swing angle to calculate current value (Ix, Iy) for the voice coil motors 150*a*-150*d* (S24), and the current value (Ix, Iy) is output as coil current (S25). The voice coil motors 150*a*-150*d* respectively drive the second collimator according to given coil current. Processes of steps S21-S25 are repeated until the completion of radiation (S26).

The process illustrated in FIG. 27 may be performed in accordance with the program stored in the memory 902 included in the in-X-ray head controller 90. According to processes illustrated in FIG. 26 and FIG. 27, the precise radiation tracking the movement of affected part can be achieved.

As described above, according to the embodiments of the present disclosure, the second collimator (secondary collimator 20 or 20A) is disposed in the first collimator (primary collimator 10), wherein the gap (OP) is provided between the second collimator and the first collimator. The radiation is performed by having only second collimator (secondary collimator 20) perform swing operation utilizing the gap (OP) so as to scan an object. Therefore, high-speed swing operation can be performed. Consequently, a continuous X-ray radiation tracking the affected part moving due to the moving body can be performed. For example, X-ray radiation to an affected part having a complex two-dimensional shape can be performed in a manner such that the swing angle gradually increases or decreases on a swing-by-swing basis, or the swing angle gradually increases or decreases once every predetermined swings.

Also, hardware or software variations of the embodiments may be adopted. Herein above, although the disclosure has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth. The present application claims priority under 35 U.S.C. § 119 to Japanese Patent Application No. 2015-149760 filed on Jul. 29, 2015, and Japanese Patent Application No. 2016-111954 filed on Jun. 3, 2016. The contents of which are incorporated herein by reference in their entirety.

As described above, the present disclosure can be used for radiation therapy of a patient whose affected part has a complex shape. However, the present disclosure can be widely applied to various apparatuses, systems, and the like. For example, the present disclosure can be applied not only to radiation therapy but also to nondestructive inspection for constructions, movable objects, deformable objects, and the like. In this case, the target may not be required because the nondestructive inspection can be conducted without using radiation, and can be conducted with e.g., infrared ray instead.

What is claimed is:

1. A collimator apparatus comprising:

a first collimator configured to prevent a leakage of radiation, wherein a target for converting an electron beam emitted from an electron beam source into the radiation is disposed in the first collimator; and a second collimator, wherein the radiation passes through the second collimator along a central axis of the second collimator, the second collimator being disposed in an inner space formed in the first collimator, a gap between a surface of the inner space and the second collimator being provided, wherein the second collimator swings within the inner space of the first collimator.

2. The collimator apparatus according to claim 1, further comprising a third collimator disposed in the second collimator, the third collimator being exchangeable.

3. The collimator apparatus according to claim 2, wherein the third collimator is fixed in an inner space of the second collimator, the third collimator swinging with the second collimator.

4. The collimator apparatus according to claim 1, further comprising:

a swing mechanism configured to cause the second collimator to swing in two directions, and a swing mechanism control unit configured to control the swing mechanism.

5. The collimator apparatus according to claim 4, wherein the swing mechanism control unit controls the swing mechanism so that the target is positioned on the central axis of the secondary collimator.

6. The collimator apparatus according to claim 4, further comprising a displacement amount detection unit configured to detect a displacement amount of the second collimator with respect to a reference position, wherein the swing mechanism control unit controls the swing mechanism based on the displacement amount detected by the displacement amount detection unit.

7. The collimator apparatus according to claim 6, wherein the displacement amount detection unit includes at least one pair of a first encoder and a second encoder, and wherein first encoders are arranged in one of the two directions and second encoders are arranged in the other of the two directions, the other direction being orthogonal to the one direction.

8. The collimator apparatus according to claim 4, wherein the swing mechanism includes a voice coil motor.

9. The collimator apparatus according to claim 1, further comprising an optical system configured to guide a visible-light laser beam toward outside the collimator apparatus in a manner such that the optical axis of the visible-light laser beam coincides with the central axis of the second collimator, the visible-light laser beam being emitted from a laser source that is disposed on a member coupled to the second collimator.

10. The collimator apparatus according to claim 1, further comprising a dosimeter configured to measure radiation dose and a radiation direction, the dosimeter being disposed in an emission side of the second collimator.

11. The collimator apparatus according to claim 1, wherein a mass of a swing unit approximately coincides with a pivot of the swing unit, the swing unit being formed by the second collimator and components attached to the second collimator.

12. A radiation system comprising:

a collimator apparatus according to claim 1;

at least two pairs of a X-ray tube generating X-ray and a X-ray detector detecting the X-ray, the X-ray detector being a planar detector; and a calculation unit configured to calculate a movement of a body part adjacent to an affected part based on a detection signal of the X-ray detector, a marker attenuating the X-ray being embedded in the body part.

13. The radiation system according to claim 12, wherein the swing operation of the second collimator is controlled based on information indicating the movement of the body part in which the marker is embedded, the body part being adjacent to an affected part, the information being provided from the calculation unit.

14. A radiation system comprising:

a X-ray head and a manipulator whose arm can move in n-axial (wherein "n" is greater than or equal to 6) directions, the X-ray head including:

an electron beam source generating an electron beam;

a target converting the electron beam into radiation;

a first collimator configured to prevent a leakage of the radiation, the target being disposed inside the first collimator;

a second collimator, the radiation passing through the second collimator along a central axis of the second collimator, the second collimator being disposed in an inner space formed in the first collimator, a gap being provided between a surface of the inner space and the second collimator;

a swing mechanism configured to cause the second collimator to swing within the inner space of the first collimator; and a swing mechanism control unit configured to control the swing mechanism, wherein the X-ray head is coupled to an end portion of the arm.

15. A method for controlling collimators, wherein the first collimator of the collimators prevents a leakage of radiation, an electron beam emitted from an electron beam gun being converted into the radiation by a target, the target being disposed inside the first collimator, and wherein the radiation passes through the second collimator along a central axis of the second collimator, the second collimator being disposed in an inner space formed in the first collimator, a gap being provided between a surface of the inner space and the second collimator, the method comprising:

causing the second collimator to swing within the inner space of the first collimator so as to irradiate a target irradiation field by the radiation passing through the second collimator.

* * * * *